US011407094B2

(12) United States Patent
Peng et al.

(10) Patent No.: US 11,407,094 B2
(45) Date of Patent: Aug. 9, 2022

(54) FASTENING TOOL HAVING A LOW NAIL, LOCKOUT MECHANISM

(71) Applicant: Black & Decker, Inc., New Britain, CT (US)

(72) Inventors: Wei-Chih Peng, Taichung (TW); Kuo-Sheng Shih, Taichung (TW)

(73) Assignee: Black & Decker, Inc., New Britain, CT (US)

( * ) Notice: Subject to any disclaimer, the term of this patent is extended or adjusted under 35 U.S.C. 154(b) by 312 days.

(21) Appl. No.: 16/378,510

(22) Filed: Apr. 8, 2019

(65) Prior Publication Data

US 2020/0156226 A1 May 21, 2020

Related U.S. Application Data

(60) Provisional application No. 62/653,919, filed on Apr. 6, 2018.

(51) Int. Cl.

| | |
|---|---|
| ***B25C 1/08*** | (2006.01) |
| ***B25C 1/04*** | (2006.01) |
| ***B25C 1/00*** | (2006.01) |

(52) U.S. Cl.

CPC ..... *B25C 1/008* (2013.01); *B25C 1/047* (2013.01)

(58) Field of Classification Search

CPC ..... B25C 1/008

See application file for complete search history.

(56) References Cited

U.S. PATENT DOCUMENTS

| | | | | |
|---|---|---|---|---|
| 4,197,974 | A | 4/1980 | Morton et al. | |
| 4,597,517 | A * | 7/1986 | Wagdy | B25C 1/008 227/120 |
| 5,180,091 | A | 1/1993 | Ota | |
| 5,368,605 | A * | 11/1994 | Miller, Jr. | A61B 17/2909 606/170 |
| 5,522,533 | A | 6/1996 | Mukoyama et al. | |
| 5,593,079 | A * | 1/1997 | Mukoyama | B25C 1/008 227/120 |
| 6,006,975 | A | 12/1999 | Ishizawa | |
| 7,143,918 | B2 | 12/2006 | Aguirre et al. | |
| 7,506,787 | B2 | 3/2009 | Wu et al. | |
| 7,600,661 | B2 | 10/2009 | Adachi | |
| 8,267,295 | B2 | 9/2012 | Wu et al. | |
| 8,292,143 | B2 * | 10/2012 | Lee | B25C 1/008 227/8 |
| 8,777,079 | B2 | 7/2014 | Po et al. | |
| 8,833,626 | B2 * | 9/2014 | Perron | B25C 1/008 227/8 |
| 9,221,161 | B2 | 12/2015 | Miller et al. | |
| 2004/0222266 | A1 | 11/2004 | Kakuda et al. | |
| 2007/0125821 | A1 | 6/2007 | Wang | |
| 2007/0138229 | A1 | 6/2007 | Fujimoto | |
| 2007/0194077 | A1 | 8/2007 | Lee | |
| 2009/0012556 | A1 * | 1/2009 | Boudreaux | A61B 17/07207 606/206 |
| 2009/0200354 | A1 | 8/2009 | Arata et al. | |
| 2010/0012700 | A1 * | 1/2010 | Perron | B25C 1/008 227/8 |

(Continued)

*Primary Examiner* — Praachi M Pathak

(74) *Attorney, Agent, or Firm* — Rhonda Barton

(57) ABSTRACT

A fastening tool having a low nail lockout mechanism pivotably mounted to the magazine assembly that prevents the tool from driving a fastener with there are less than a predetermined number of fasteners in the magazine.

20 Claims, 26 Drawing Sheets

(56) References Cited

U.S. PATENT DOCUMENTS

| | | | | |
|---|---|---|---|---|
| 2011/0006098 | A1 | 1/2011 | Maltais et al. | |
| 2011/0168753 | A1 | 7/2011 | Wu | |
| 2012/0187175 | A1 | 7/2012 | Wu et al. | |
| 2014/0252060 | A1* | 9/2014 | Segura | B25C 1/008 227/8 |
| 2016/0325419 | A1* | 11/2016 | Sperrfechter | B25C 1/08 |
| 2018/0064457 | A1* | 3/2018 | Dannoritzer | A61B 17/2841 |
| 2019/0099872 | A1* | 4/2019 | Tanaka | B25C 1/008 |
| 2020/0156226 | A1* | 5/2020 | Peng | B25C 1/047 |

* cited by examiner

FASTENING TOOL HAVING A LOW NAIL, LOCKOUT MECHANISM

CROSS-REFERENCE TO RELATED APPLICATIONS

The present application claims priority under 35 U.S.C. § 119 to U.S. Provisional Application Ser. No. 62/653,919 entitled Fastening Tool Having a Low Nail Lockout Mechanism, filed on Apr. 6, 2018, which is herein incorporated by reference in its entirety.

BACKGROUND OF THE INVENTION

Field of the Invention

The present invention relates, in general, to the field of power tools. In particular, the present invention relates to a fastening or driving tool, such as a nailer and more particularly to improvements in such tools for clearing the drive track of jammed fastener, controlling the depth of drive of a fastener into a workpiece, and preventing the dry firing of the tool. In particular, the present invention relates to a fastening tool having a low nail lockout that prevents the firing of the tool when there are less than a predetermined number of fasteners remaining in the tool.

Description of the Related Art

Different types of fastening tools are known including portable pneumatically actuated devices, electrically actuated devices, hammer actuated devices, manual actuated devices, etc. Fastening tools, such as power nailers have become relatively common place in the construction industry. Pneumatically-powered nailers, which are connected to an air compressor via an air hose, are popular in the market.

Many different types of fastening tools are known including portable pneumatically actuated devices, electrically actuated devices, hammer actuated devices, manual actuated devices, etc. A common characteristic of all these types of fastening tools is the provision of a drive track, a fastener driving element mounted in the drive track and a magazine assembly for receiving a supply of fasteners in stick formation and feeding successive leading fasteners in the stick laterally into the drive track to be driven outwardly thereof by the fastener driving element. During fastening users are often unaware that the magazine has been depleted of fasteners and continue to try to drive fasteners into a workpiece by pressing the trigger. This is known as a dry fire situation. A dry fire situation causes the tool to recoil from the force of the nosepiece against the workpiece. As a result, the nosepiece can leave an indentation on the workpiece. If the workpiece is a wood material, the word can be damaged.

Accordingly, there is a need in the art for a nailer that is capable of reliably preventing the firing of the nailer when there are no nails in the magazine.

SUMMARY OF THE INVENTION

In an embodiment, the present invention is a fastening tool including a housing; a nosepiece assembly connected to the housing and including a fastener drive track; a magazine assembly including a magazine pusher slidably disposed in the magazine assembly for feeding fasteners successively along a pusher path to the fastener drive track of the nosepiece assembly; and an engine carried by the housing and configured to drive the fastener along a drive axis out of the fastener drive track and into a workpiece. The fastening tool includes a trigger pivotably connected to the housing and a trigger valve that selectively controls the flow of pressurized gas to the engine when the trigger is pulled. A trigger arm is pivotably mounted on the trigger and has an engaged position and a disengaged position. The trigger arm is operable to actuate the trigger valve when the trigger arm is in the engaged position and to bypass the trigger valve when the trigger arm is in the disengaged position. A lockout lever is provided and is pivotally mounted to the tool such as, for example, to the housing, and configured to move the trigger arm from the engaged position to the disengaged position when there are less than a predetermined number of fasteners in the magazine assembly.

In the engaged position, a surface of the trigger arm presses against the trigger valve allowing the flow of pressurized gas to enter the engine and activate the tool.

In an embodiment, the trigger arm defines a recess in a surface thereof. In the disengaged position, the trigger arm bypasses the trigger valve at the recess, preventing pressurized gas from entering the engine, thereby preventing activation of the tool.

The lockout lever has an elongated lockout lever body arranged parallel to the drive axis. In an embodiment, the lockout lever defines a head portion at one end that is biased toward the pusher path by a compression spring. The head portion extends perpendicularly from the lockout lever body and protrudes into the pusher path when there are less than a predetermined number of fasteners in the magazine assembly. The head portion can protrude into the pusher path through a slot in the magazine assembly.

The lockout lever also defines a tail portion at an opposite second end to the head portion. The tail portion is operatively connected to and controls movement of the trigger arm through an aperture at one end of the trigger arm.

When the head portion of the lockout lever moves to protrude into the pusher path, the tail portion of the lockout lever moves the trigger arm to the disengaged position The lockout lever also defines an intermediate portion between the head portion and the tail portion and the intermediate portion defines a pivot point about which the lockout lever is pivotally mounted to the housing.

When the head portion of the lockout lever is biased to protrude into the pusher path, the tail portion of the lockout lever moves away from the magazine assembly.

The lockout lever can be formed from a material including, but not limited to a metal.

A lockout lever housing can be disposed around the lockout lever to encase the lockout lever, thereby preventing dust and debris from contacting the lever and interfering with the lockout mechanism. The lockout lever and lockout lever housing can be arranged on a laterally opposite side of the magazine to the magazine pusher. The lockout lever can be moveable relative to the lockout lever housing.

In an embodiment of the present invention, a low nail lockout mechanism for a fastening tool can include a lockout lever having an elongated body and being defined by a head portion extending perpendicularly from one end of the elongated body, a tail portion at an opposite longitudinal end of the elongated body, and an intermediate portion between the head portion and the tail portion and defining a pivot axis about which the lockout lever pivots. In addition, the low nail lockout mechanism can include a biasing member that biases the head portion in a first direction and the tail portion in a second direction opposite to the first direction.

The biasing member of the low nail lockout mechanism can be a compression spring that engages the lockout lever at the head portion.

BRIEF DESCRIPTION OF THE DRAWINGS

The numerous advantages of the present invention may be better understood by those skilled in the art by reference to the accompanying Figures. In the drawings, like reference numerals designate corresponding parts throughout the several views.

Corresponding reference numerals indicate corresponding parts throughout the several views of the drawings.

DETAILED DESCRIPTION OF THE INVENTION

Figure 1:
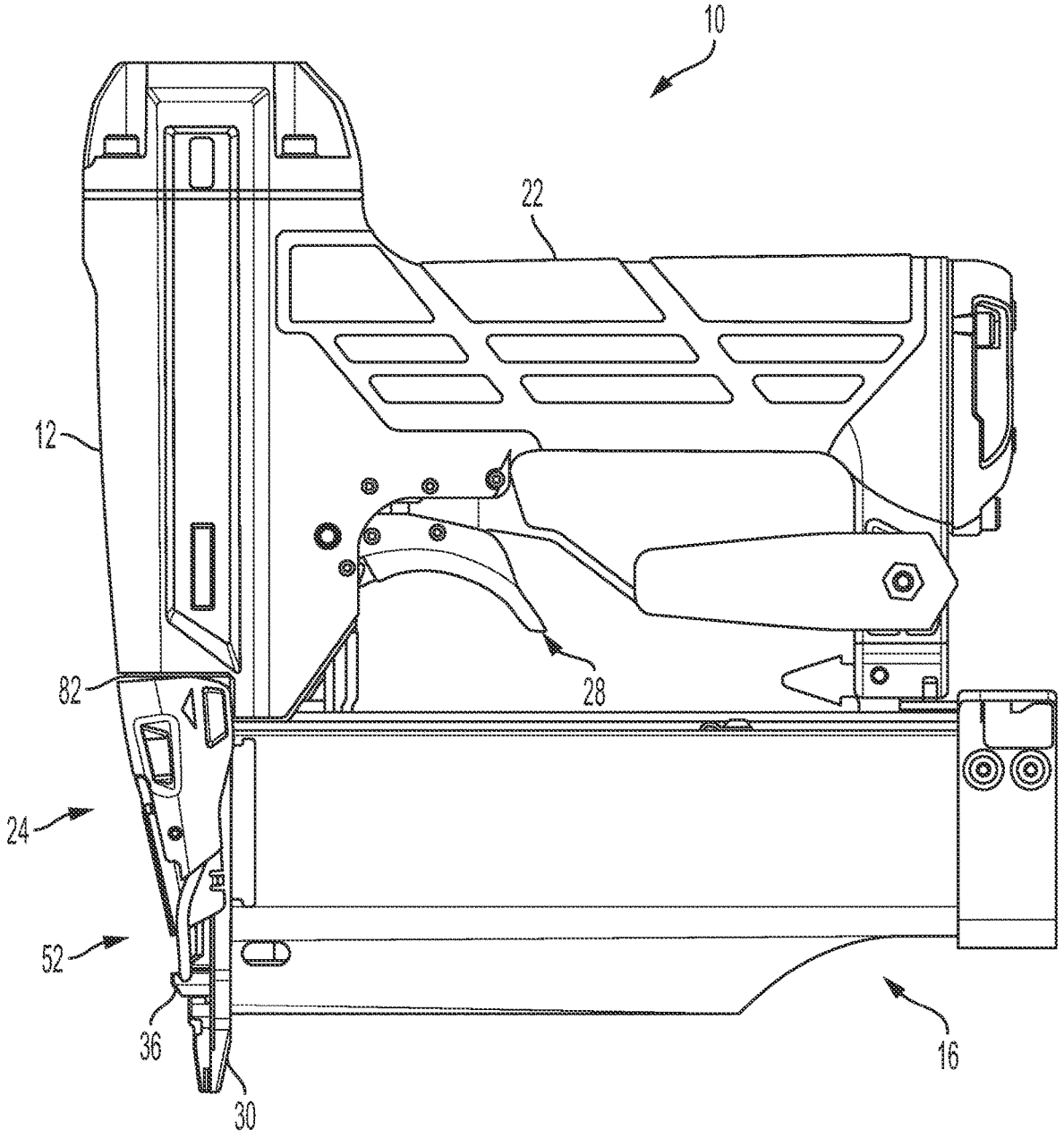
FIG. 1 is a side view of an exemplary fastening tool constructed in accordance with the teachings of the present disclosure and showing a latch mechanism in a latched position.
Figure 2:
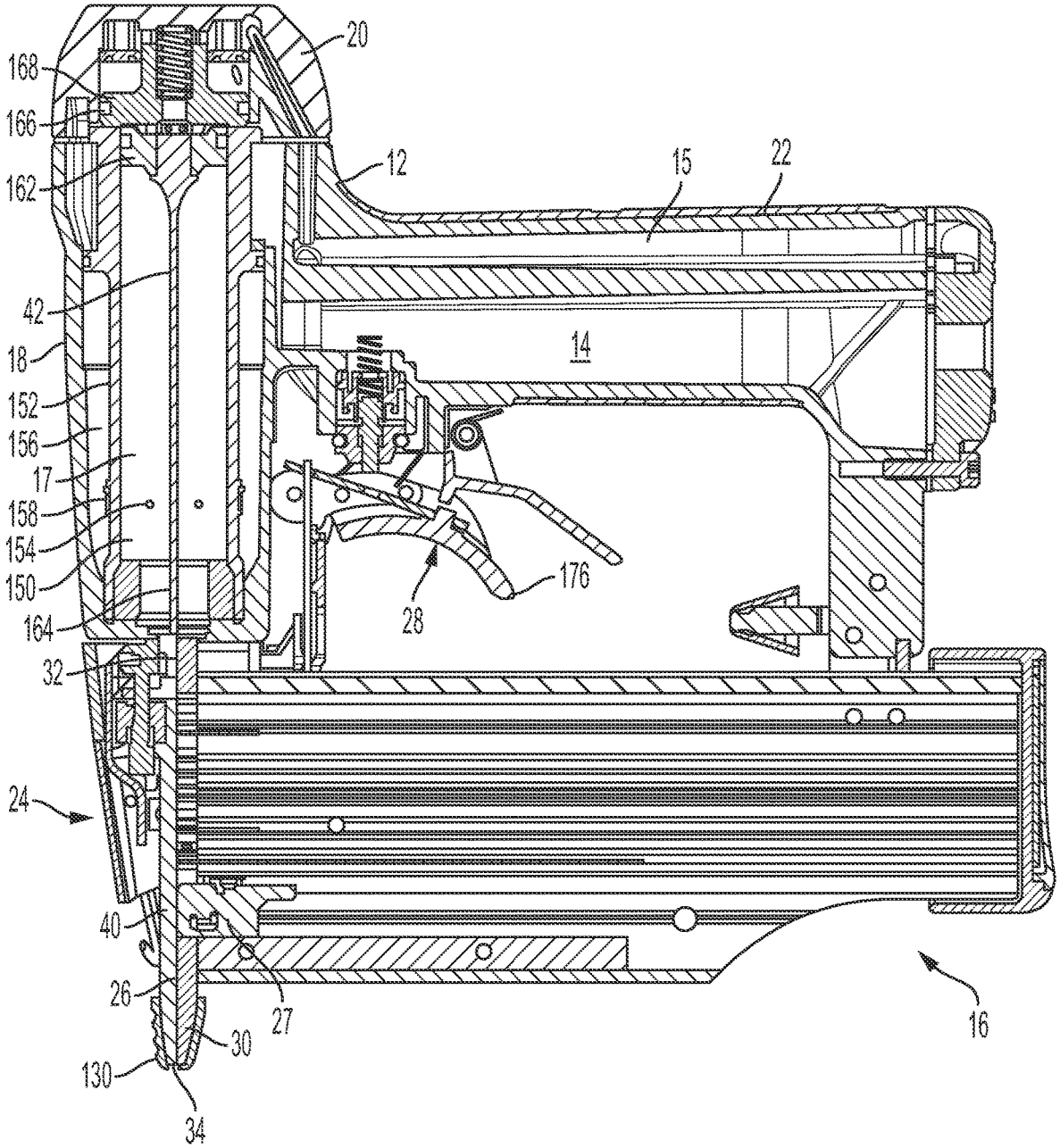
FIG. 2 is a cross-sectional view of the fastening tool of FIG. 1.

FIGS. 1 and 2 illustrate a fastening tool 10 according to an embodiment of the invention. The fastening tool includes a tool-free jam release system 52, a depth adjustment mechanism 100 and a low nail lockout mechanism 190.

According to several aspects, the fastening tool 10 is a pneumatically powered nailer, however the fastening tool can be any type of portable tool including a battery operated nailer. The fastening tool 10 includes a housing 12, a nosepiece assembly 24 extending forward of and fixed to the housing 12, and a magazine assembly 16 operatively connected to both a handle portion 22 of the housing and the nosepiece assembly. The nosepiece assembly 24 defines a fastener drive track 26 through which fasteners F, such as nails, are driven. The housing 12 provides a trigger assembly 28 for actuating operation of the fastening tool 10.

As illustrated, the housing 12 includes an engine receiving portion 18. The handle portion 22 may extend substantially perpendicularly from the engine receiving portion 18. The handle portion 22 is configured to be received by a user's hand, thereby making the fastening tool 10 portable. Additional portability can be achieved by constructing the housing 12 from a lightweight yet durable material, such as magnesium.

The housing 12 additionally contains components such as a pressurized gas reservoir 14 and an engine 150 for driving a fastener F into a workpiece. The reservoir 14 is configured to receive a pressurized gas that is used to power the fastening tool 10. The reservoir 14 is substantially defined by the handle portion 22, although it is contemplated that a portion of the reservoir 14 may be defined by the engine receiving portion 18 as well. In an embodiment, the handle portion 22 may also include a second reservoir 15 that is configured to be open to atmosphere and is configured to allow exhaust gas to exit the fastening tool 10 through the handle portion 22.

In an embodiment, the pressurized gas may be provided to the reservoir 14 from a compressor through a hose. The hose may be connected to the fastening tool 10 via a fitting (not shown) that may be attached to the housing 12. Alternatively, the pressurized gas may be provided to the reservoir 14 through a cartridge. In an embodiment, the pressurized gas may be air that has been compressed by a compressor, as is commonly used in pneumatic tools. It is also contemplated that any gas that releases energy upon expansion, such as a gas produced as a by-product of combustion, or a gas that is produced upon a phase transformation of a liquid, such as carbon dioxide may also be used to power the fastening tool 10. The illustrated embodiment is not intended to be limiting in any way.

As shown in FIG. 2, the engine 150 is disposed in the engine receiving portion 18 of the housing 12. The engine is configured to drive the fastener along a drive axis DA out of the fastener drive track 26 and into a workpiece;

The engine 150 includes a cylinder 152 and a fastener driver 42 that is movably mounted in the cylinder 152, and, hence, the housing 12. The cylinder 152 is oriented such that its longitudinal axis substantially aligns with a longitudinal axis of the drive track 26. The cylinder 152 includes a plurality of openings 154 that are arranged circumferentially around the cylinder 152 at an intermediate portion thereof. The openings 154 allow gas that is in the cylinder 152 to flow into a plenum 156 that is defined by an outside surface of the cylinder 152 and the housing 12. The openings 154 are provided with seals 158 that act as one-way valves such that gas may exit the cylinder 152 into the plenum 156, but gas in the plenum 156 may not enter the cylinder 152 through the openings 154. Instead, gas may enter the cylinder 152 through at least one opening 160 that is located towards one end of the cylinder 152 near the drive track 26, as shown in FIG. 2. Movement of gas in and out of the cylinder 152 will be discussed in greater detail below in connection with the operation of the tool 10.

The engine 150 also includes a head valve 168, shown in FIG. 2 that is disposed above the cylinder 152. The head valve 168 is constructed and arranged to substantially seal the top of the cylinder 152 from the reservoir 14 when the head valve 168 is in a closed position, and move away from the cylinder 152 when the head valve 168 is moved to an open position. A head valve spring (not shown) is disposed between the head valve 168 and the cap 20 such that the head valve 168 is biased to the closed position when there is no pressurized gas in the tool 10 or when the pressurized gas applies equal force on both sides of the head valve 168. The head valve 168 is constructed and arranged to be actuated so as to allow the pressurized gas that is in the reservoir 14 to enter the cylinder 152 and move the fastener driver 42 through an operating cycle. Each cycle includes a drive stroke in which the driver 42 moves along the drive axis DA and drives the leading fastener into the workpiece, and a return stroke in which the driver 42 is returned to its initial position so that it is ready for another drive stroke.

The fastener driver 42 is configured to enter the drive track 26 and drive the successive leading fasteners, one at a time, into the workpiece. The fastener driver 42 may have any configuration. In the illustrated embodiment, the fastener driver 42 includes a piston 162 and a drive rod or driver blade 164 that is connected to the piston 162. A seal 166 is provided between the piston 162 and an interior wall of the cylinder 152 so as to form a slidable seal. This allows pressure on one side of the piston 162 to be different from pressure on the other side of the piston 162 so that a pressure differential may effect movement of the piston 162. The driver blade 164, although illustrated as pinned, may be connected to the piston 162 by any suitable fastening technique, such as a threaded or a welded connection. The illustrated embodiment is not intended to be limiting in any way. The driver blade 164 may have a substantially circular cross-section, or the driver blade 164 may have a cross-section that is rectangular shaped, D-shaped, or is shaped as a crescent, as would be understood by one of ordinary skill in the art.

The trigger assembly 28 serves as an actuation device or actuator and is constructed and arranged to actuate the head valve 168, and, hence, initiate the drive stroke. The actuator or trigger assembly 28 includes a trigger valve 172, a trigger 176, and a trigger arm 178 that interacts with the trigger valve 172, as discussed in further detail below. The trigger arm 178 is pivotally mounted to the trigger 176 on an underside thereof. The trigger arm 178 is connected to the trigger by a boss 179 and pivots with respect to the trigger on a pivot boss axis B. The boss axis is parallel to the drive axis DA.

The trigger valve 172 is constructed and arranged to allow passage of the pressurized gas from the reservoir 14 to the engine 150 and, in particular, to a chamber above the head valve 168 through a passageway (not shown), and to selectively allow passage of gas from the chamber through an exhaust opening in the trigger valve 172.

The trigger valve 172 may be moved to the actuated position by pressing a valve stem 174 against the force applied on the valve stem 174 by the pressurized gas, and the bias of a valve spring 165 that is disposed within the trigger valve 172. This may be done with the user's finger or can be done with the trigger arm 178. In at least one embodiment of the present invention, the trigger 176 is rotatably mounted to the housing 12. In an embodiment of the present invention, the trigger 176 may be linearly mounted so that the trigger 176 has linear movement rather than rotational movement, as discussed in further detail below. When the trigger 176 is moved toward the valve stem 174 while the nose portion 30 is in contact with the workpiece, the trigger arm 178 engages the valve stem 174 and presses the valve stem 174 against the bias of the valve spring 165 in the trigger valve 172. When the trigger valve 172 is actuated, i.e. when the valve stem 174 is moved against the bias of the valve spring 165 in the trigger valve 172, the passageway within the trigger valve 172 between the chamber above the head valve 168 and the exhaust opening is opened, and the pressurized gas in the chamber is now able to flow through the trigger valve 172 and out the exhaust opening.

Actuation of the head valve 168, or movement of the head valve 168 to the open position, will depend on whether the pressurized gas from the chamber above the head valve 168 is exhausted to atmosphere through the trigger valve 172. Once the pressurized gas from the chamber starts to be exhausted, the pressure within the chamber drops. This pressure drop, when high enough, allows the head valve 168 to move to the open position due to the force being exerted on the head valve 168 by the pressurized gas within the reservoir 14, which is at a greater pressure. Additional details of suitable engines and actuators for the fastening tool 10 may be found in, for example, U.S. Pat. Nos. 7,134,586, 7,143,918, and 7,677,426, the entire contents which are incorporated herein by reference.

Regarding the structural components of fastener driving, the nosepiece assembly 24 also includes a pair of hooks 36 that project outwardly from a surface of the nose portion 30. The pair of hooks 36 can be integrally formed with the nose portion 30. The hooks 36 are disposed on opposite lateral sides, such as, arranged laterally across the nose portion 30 and can be open or curved toward the housing 12. As such, the hooks can have a concave profile facing the housing. The hooks 36 serve to engage a portion of the latching mechanism in a latched position.

Figure 10:
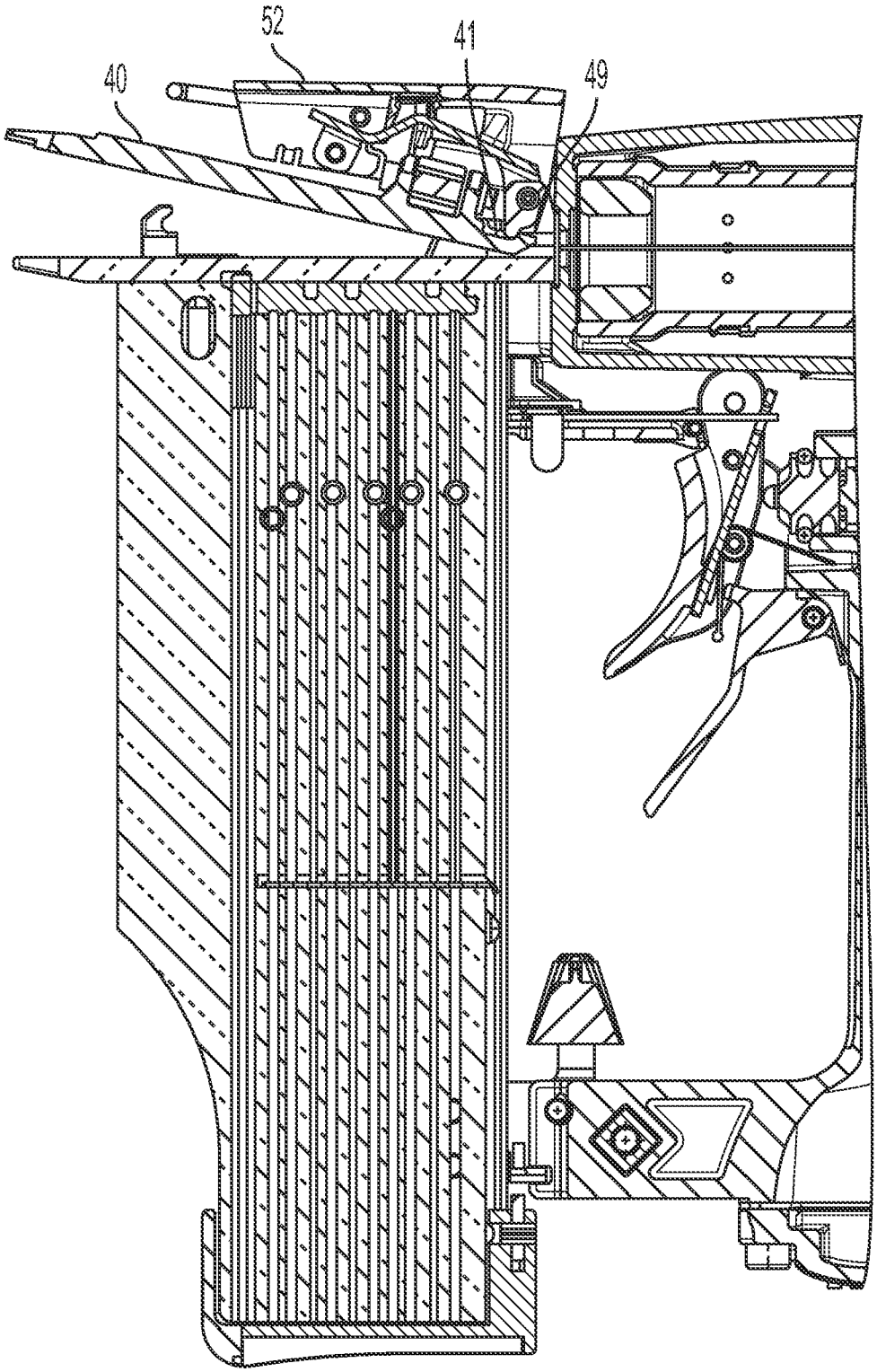
FIG. 10 is a cross-sectional side view of the nosepiece assembly with the latch mechanism in an unlatched position.

A pivoting door 40 is arranged along the longitudinal length of the nose portion 30 between the laterally arranged pair of hooks 36. The door 40 has a rigid body and provides a platform on which a depth adjustment wheel 38 can be mounted. The door 40 has a proximal end 42 adjacent to the housing 12, a distal end 44 that can engage the no mar tip 130, and laterally projecting flanges 46. The proximal end 42 of the door 40 is sandwiched between a door plate 48 and the nose portion 30. The proximal end 42 of the door 40 includes a lateral groove 41 (FIG. 10) in which a projecting lip 49 of the door plate 48 sits. The projecting lip 49 provides forward and rearward limits on the distance that the door 40 can slide in order to correspond to the selected depth defined by the depth adjustment wheel 38. The door 40 also pivots about the projecting lip 49 of the door plate 48 so that the door can open with respect to the nose portion 30 for the removal of a jammed fastener.

A resilient stop member 50 (See also FIG. 7) projects from an aperture in the nose portion 30 toward the proximal end 42 of the door 40. The stop member 50 engages at least one of a pair of flanges 46 projecting laterally from the proximal end 42 of the door 40. The stop member 50 prevents the door 40 from moving longitudinally beyond a predetermined distance and becoming dislodged from the nosepiece assembly 24. The resilient stop member can be a U-shaped spring.

In combination, the nose portion 30 and the door 40 define the fastener drive track through which fasteners pass from the magazine assembly 16 to the ejection end of the nosepiece assembly 24.

Fasteners are temporarily contained in the magazine assembly 16 which can be connected to the nosepiece assembly 24. The magazine assembly 16 is constructed and arranged to feed successive leading fasteners from a supply of fasteners contained therein along a feed track and into the drive track 26. The supply of fasteners is urged toward the drive track 26 by a magazine pusher 27 that is slidably disposed in the magazine assembly to travel along a magazine pusher path 29. The magazine pusher is biased towards the drive track 26 and engages the last fastener in the supply of fasteners to thereby feed individual fasteners from the magazine assembly to the nosepiece assembly. Although the illustrated magazine assembly 16 is configured to receive fasteners that are collated in a stick configuration, it is also contemplated that a magazine assembly that is configured to accommodate fasteners that are collated in a coil formation may also be used. The illustrated embodiment is not intended to be limiting in any way.

The fastening tool includes a tool-free jam release system in the form of a latch mechanism 52. The latch mechanism 52 is operatively connected to the nosepiece assembly 24 in both a latched position and an unlatched position. As shown in FIG. 2, the latch mechanism 52 is in a latched position. In the latched position, the latch mechanism 52 is disposed along the longitudinal length of the nosepiece assembly 24 and arranged to cover at least a portion of the nosepiece assembly. A portion of the latch mechanism 52 also engages the concave portion of the pair of hooks 36 on the nose position 30. Although a pair of hooks are illustrated other arrangement of holding members including a single holding member are contemplated to engage the latch member 56.

Figure 3:
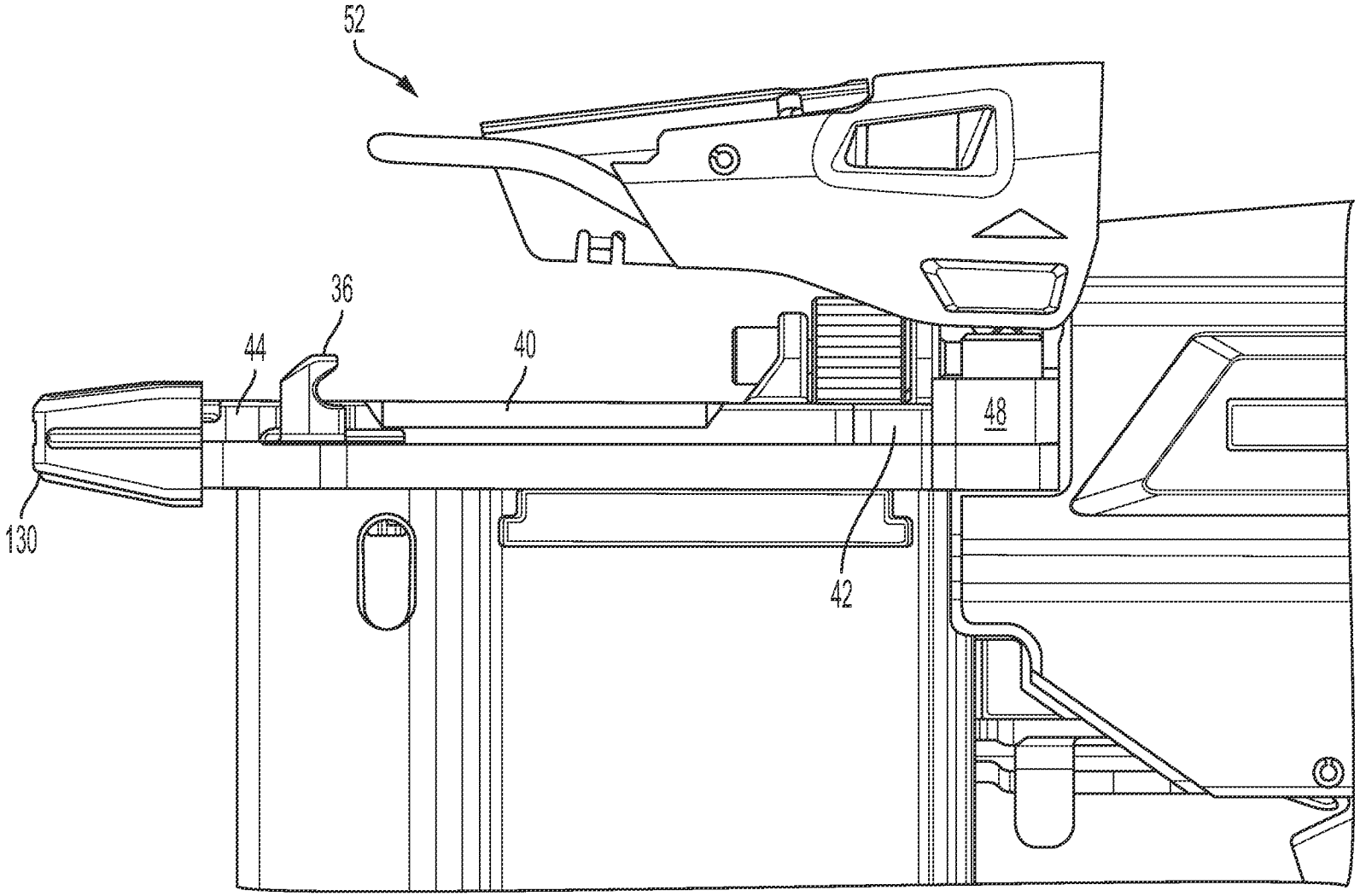
FIG. 3 is a side view of the nosepiece assembly of the fastening tool of FIG. 1.

As shown in FIG. 3, the latch mechanism 52 is in an unlatched position. In the unlatched position, the latch mechanism 52 is disengaged from the pair of hooks 36. As a result, the door 40 can be accessed and opened to remove jammed fasteners from the nosepiece assembly 24.

Figure 4:
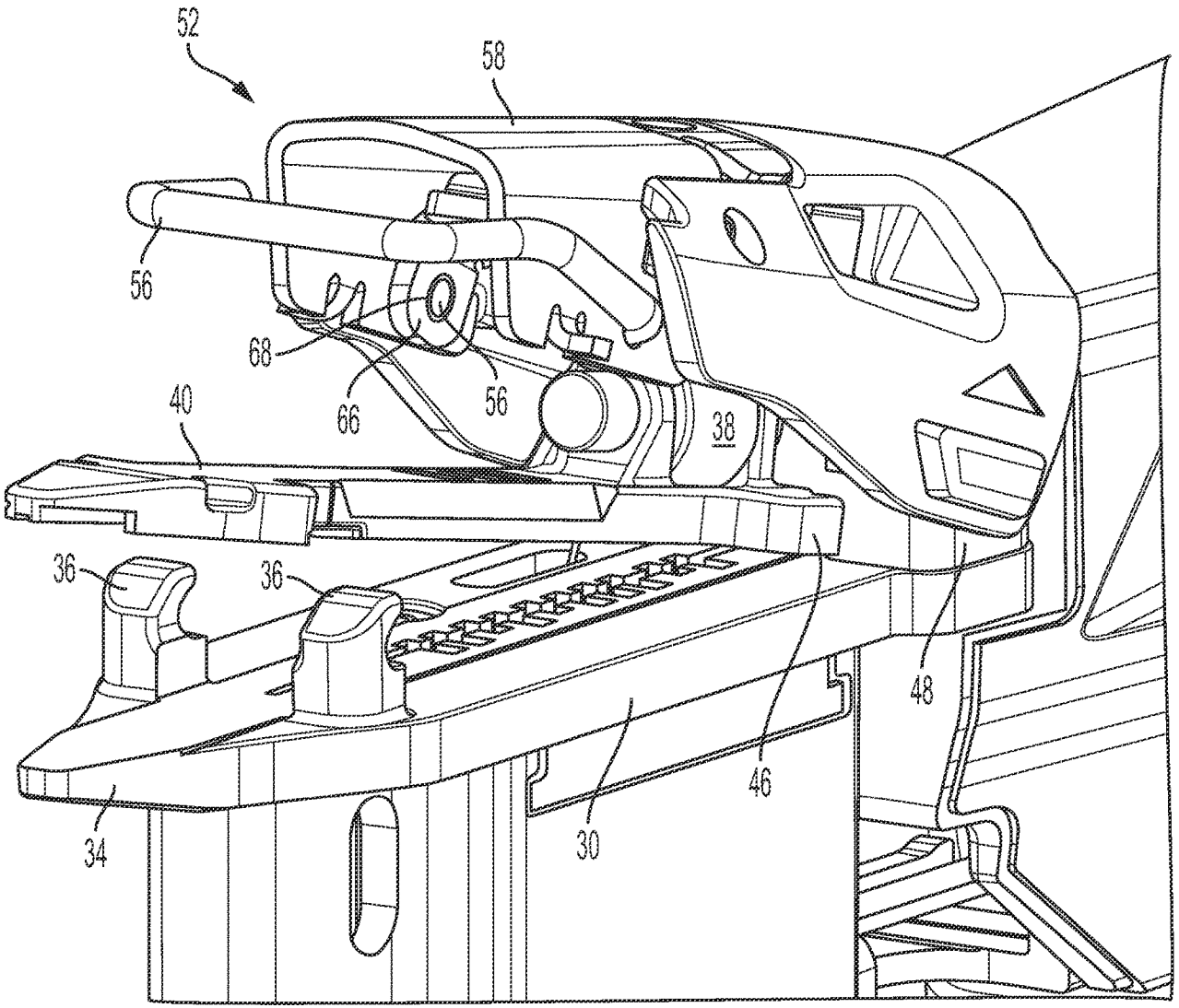
FIG. 4 is a side perspective view of the nosepiece assembly of the fastening tool of FIG. 1.
Figure 5:
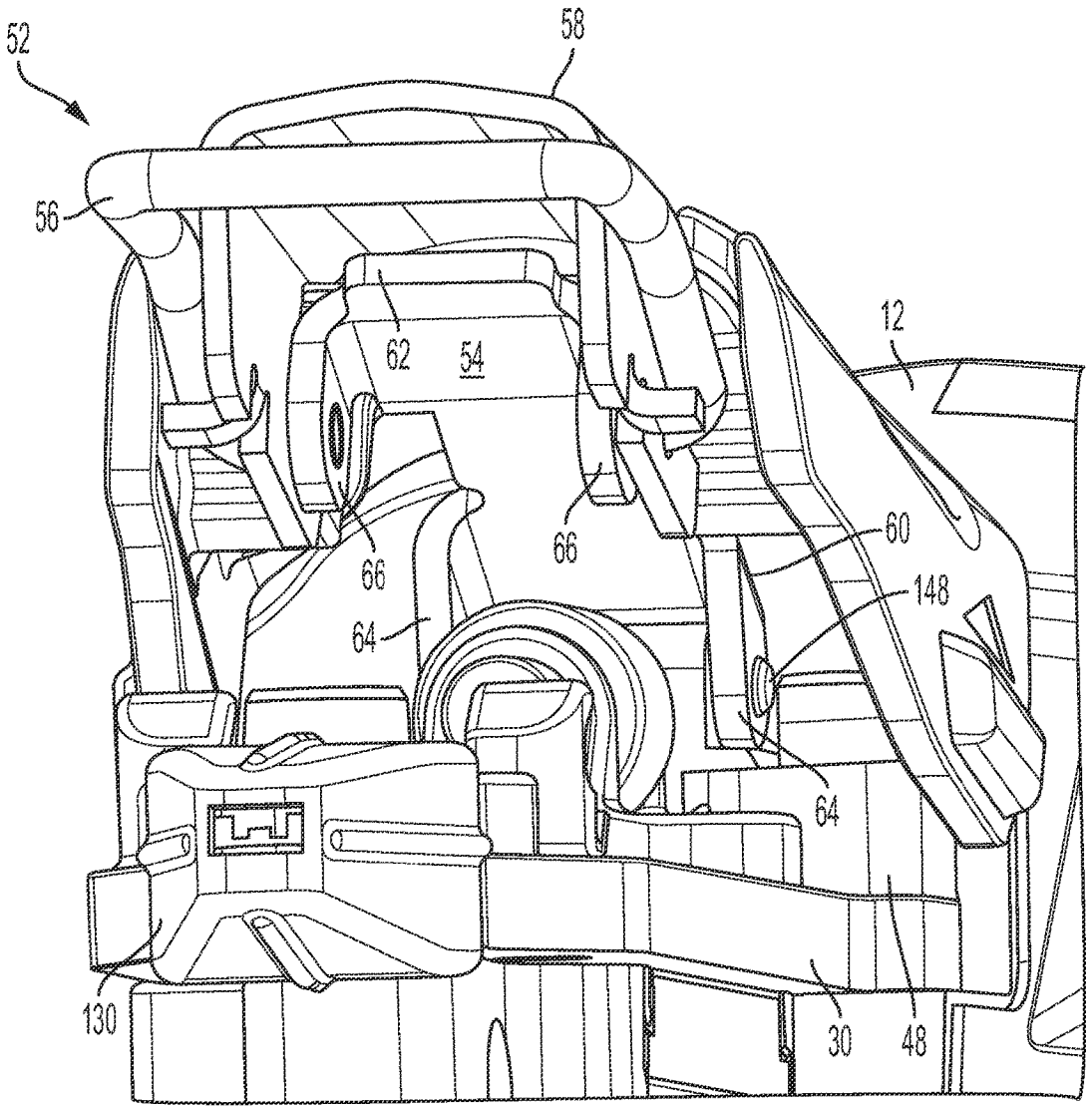
FIG. 5 is a front perspective view of the nosepiece assembly and latch mechanism of the fastening tool of FIG. 1.

As best illustrated in FIGS. 4 and 5, the latch mechanism 52 includes a latch plate 54, a latch member 56 in the form of a latch wire or clip, and a latch cover 58.

The latch plate 54 is disposed within a recess defining the underside of the latch cover 58. The latch plate 54 is an elongated body having a first end 60 and an opposite second end 62 and two pairs of orthogonally projecting or depending rear flanges 64 and forward flanges 66. The pair of depending rear flanges 64 is arranged at the first end 60 of the latch plate 54 and the pair of depending forward flanges 66 is arranged at the second end 62 of the latch plate 54. The flanges 64, 66 are disposed on opposite lateral sides and project from a side of the latch plate 54 opposite the latch cover 58. The first end 60 of the latch plate 54 is pivotally connected to the door plate 48 by a pin 148 that passes through an aperture in each of the pair of projecting flanges. The pin 148 has an axis perpendicular to the drive axis DA and allows the latch plate 54 to be pivotable toward and away from the nose portion 30 and the door 40. Each of the pair of forward projecting flanges 66 on the second end 62 of the latch plate 54 have apertures 68 through which the latch member 56 is connected thereto. The latch plate 54 has a non-linear profile that creates a space below the latch plate for the depth adjustment wheel 38.

The latch member 56 projects forwardly from the latch plate 54, toward the second end 34 of the nose portion 30 in order to engage the pair of hooks 36. In the latched position, the latch member 56 engages the hooks 36 to secure the latch mechanism 52 on the nose portion 30. In this position, the latch member 56 further exerts or transmits an outward force against the pair of hooks 36 in the direction toward the second end 62 of the nose portion 30. Engagement of the latch member 56 and the pair of hooks 36 creates a compressive stress on the latch mechanism 52.

In the unlatched position, the latch member 56 is disengaged from the pair of hooks 36. The latch member 56 can have a U-shape and be formed from a metal, such as, for example, steel. Although a pair of hooks are illustrated other arrangement of holding members including a single holding member are contemplated to engage the latch member 56.

Figure 6:
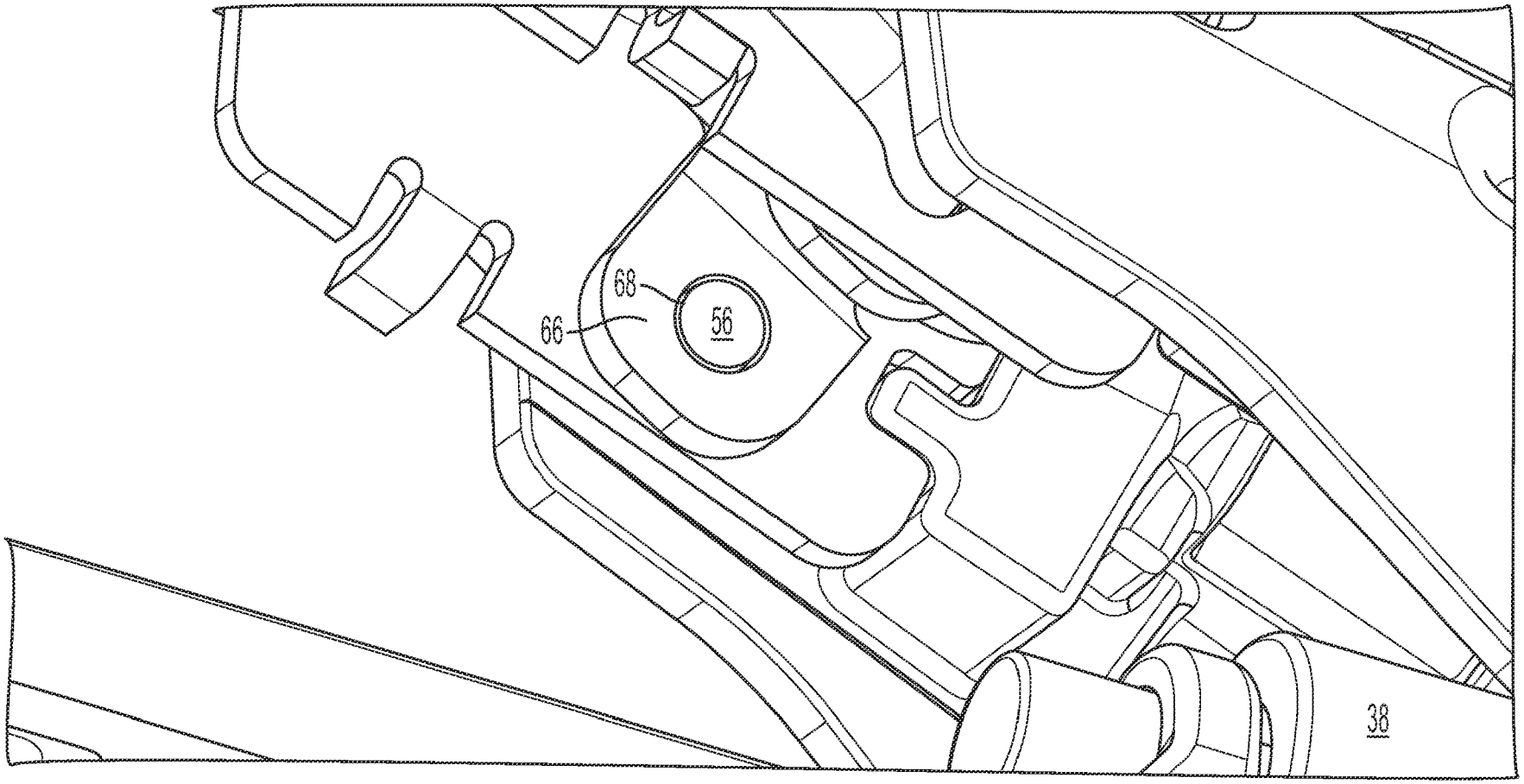
FIG. 6 is an enlarged view of the latch wire and latch plate connection.
Figure 7:
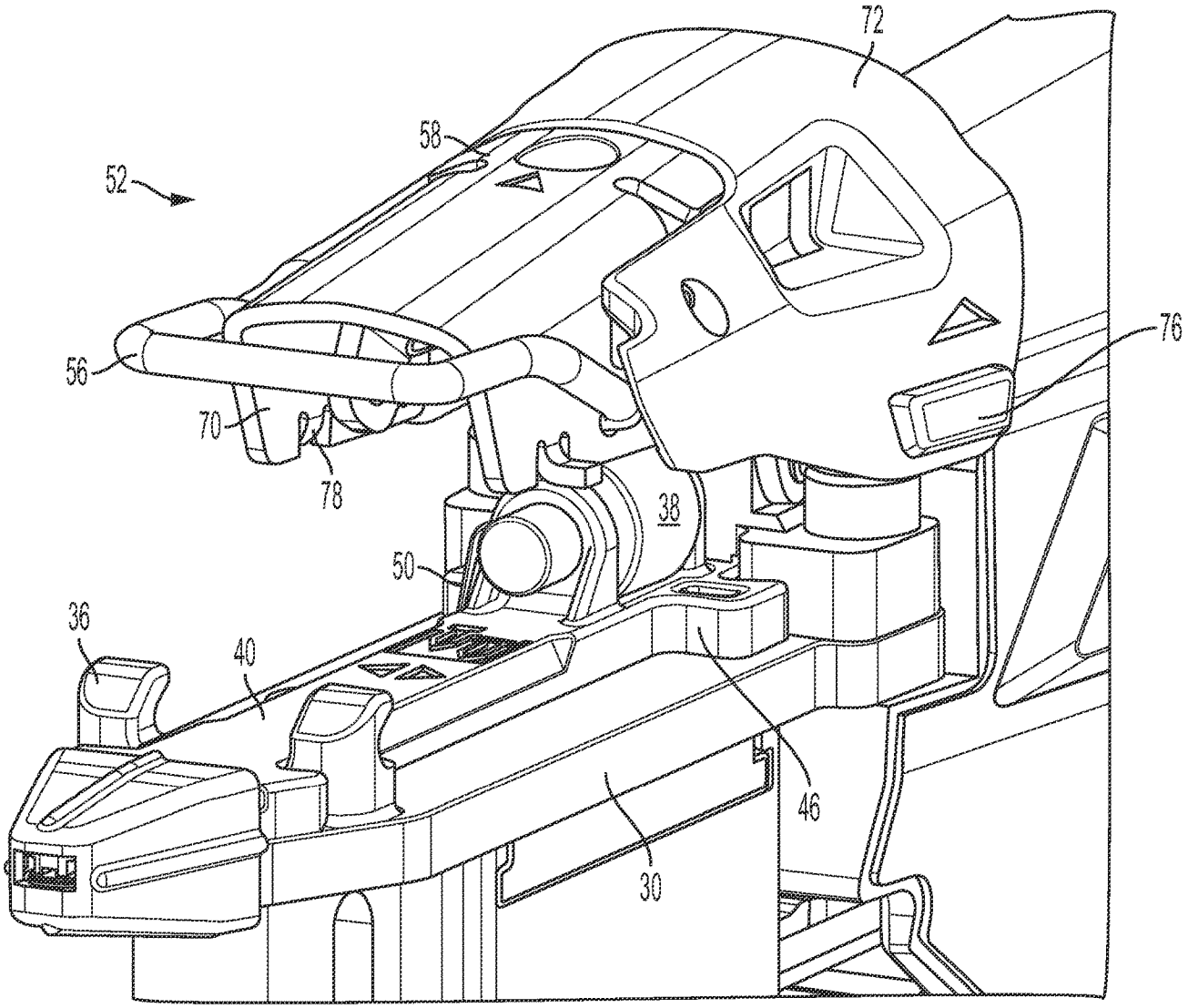
FIG. 7 is a top perspective view of the nosepiece assembly and latch mechanism of the fastening tool of FIG. 1.

With reference to FIGS. 5, 6 and 7, the latch member 56 is pivotally coupled to the latch cover 58, through the same apertures 68 in the latch plate 54.

Figure 8:
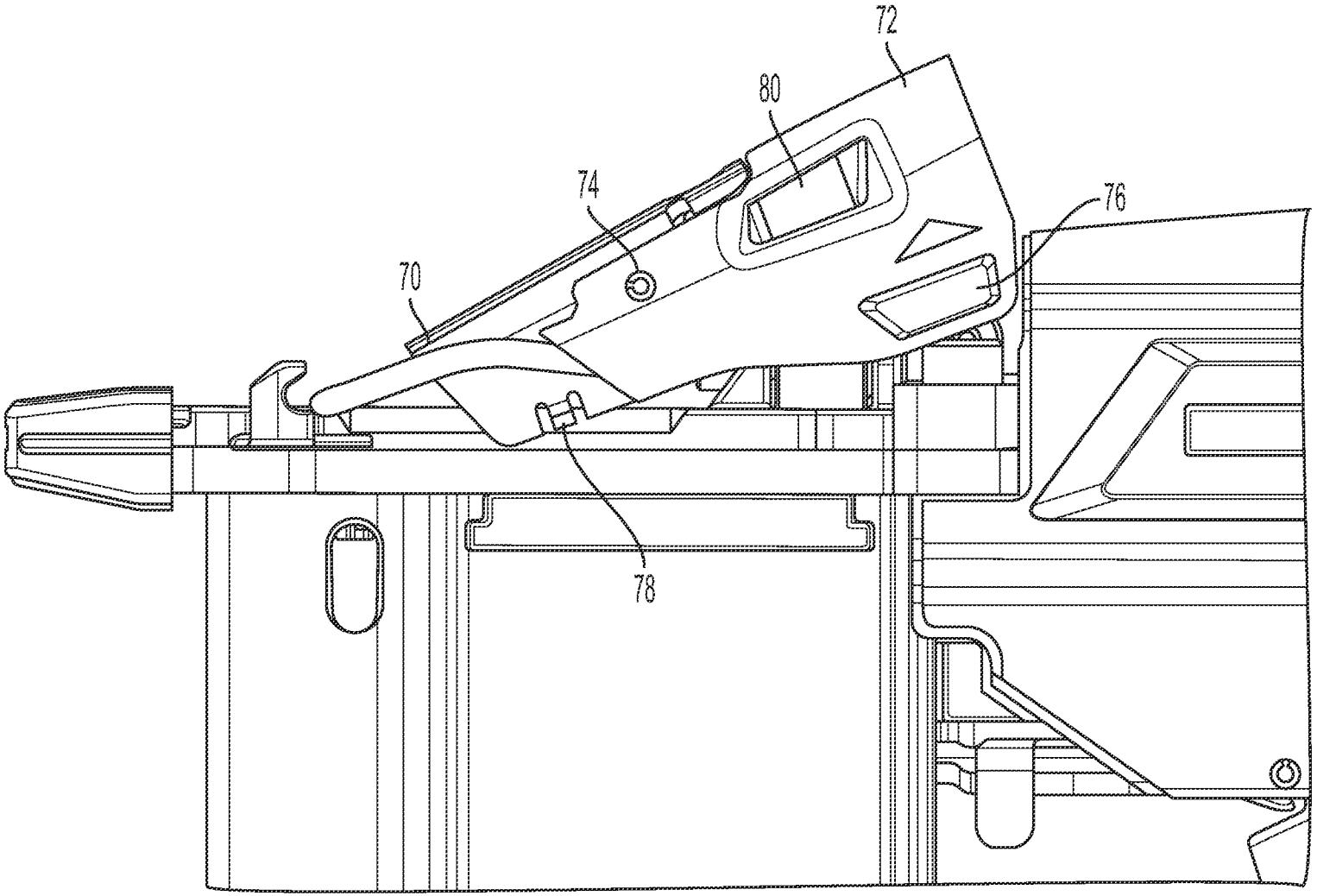
FIG. 8 is a side view of the nosepiece assembly with the latch mechanism in an unlatched position.
Figure 9:
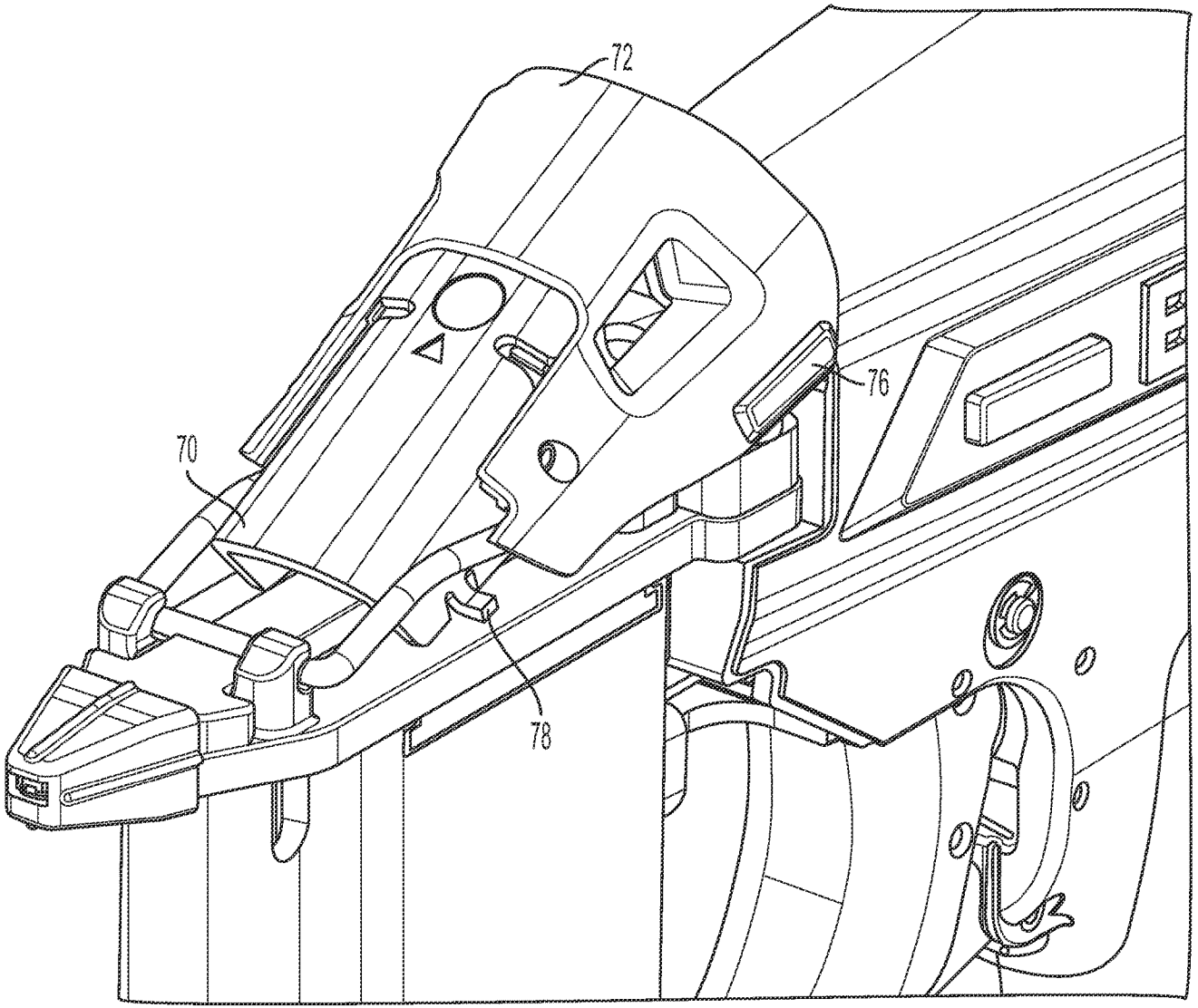
FIG. 9 is a top perspective view of the nosepiece assembly with the latch mechanism in an unlatched position.

In an embodiment, the latch member 56 is formed from a metal and has a resilient body. As shown in FIGS. 7, 8 and 9, a center portion of the latch member 56 is engageable with the hooks 36. The latch member 56 is pivotally supported on the latch plate 54 for spring biased releasable engagement with the hooks 36 thereby latching the latch plate 54 on the nose portion 30. It should be appreciated that various other shaped wires or clips 56 may be employed.

The latch cover 58 can be formed as a rigid body. In an embodiment, illustrated in FIGS. 7, 8 and 9, the latch cover 58 can have a forward portion 70 and a rearward portion 72. The forward portion 70 can be formed from a first material and the rearward portion 72 can be formed from a second material where the first material is different from the second material. For example, the first material can be a metal and the second material can be a plastic. Alternatively, the first and second materials can be two distinct kinds of plastic. In another embodiment, the first material can be the same as the second material. Alternatively, the rigid body can be formed from metal alone.

The forward 70 and rearward 72 portions can be fixed together, such as by being coupled to each other by spring pins 74, as shown in FIG. 8. In a further embodiment, the latch cover 58 can be integrally molded or forged as a single piece of the same material.

In an embodiment where the forward portion 70 is formed from a metal, and the rearward portion 72 is formed from plastic, the metal provides structural rigidity and the plastic provides a cover for a smooth appearance of the front of the tool as well as providing a grasping point for the user to easily lift the latch cover 58 with their fingers. In this regard, the latch mechanism 52 is user friendly and allows the user to open the nosepiece without the use of tools.

In an embodiment, the latch cover 58 can also include a gripping section 76 that defines a location for the user to place their fingers for grasping and lifting the latch cover 58. The gripping section 76 facilitates movement of the latch member 56 from engagement with the pair of hooks 36 to disengagement from the pair of hooks, thereby facilitating movement of the latch mechanism from the latched position to the unlatched position. Lifting the latch cover exposes the door 40 and nose portion 30 and allows the user to remove a fastener that is jammed in the fastener drive track 26. In an embodiment, the gripping section 76 can be a protruding member. In another embodiment, the gripping section can be a substantially planar textured or ribbed surface. In a further embodiment, the gripping section 76 can be a protruding member having a textured or ribbed surface. In an embodiment, the gripping section 76 can be disposed on the rearward portion 72 of the latch cover 58.

The forward portion 70 of the latch cover 58 includes stoppers 78 on opposite lateral sides. The stoppers 78 project outwardly to prevent the latch member 56 from swinging toward the nose portion 30 when the latch mechanism 52 is unlatched, such as when the latch member 56 is disengaged from the pair of hooks 36.

The rearward portion 72 of the latch cover 58 includes a window 80 therethrough for indicating the presence of the depth adjustment wheel 38. The depth adjustment wheel 38 can be accessed when the latch cover 58 is opened.

In operation, when the latch member 52 is in a latched position over the nose portion 30, the latch member 56 is received firmly within the hooks 36 of the nose portion 30. This is due to the latch member 56 having a bend along its longitudinal length. Thus, the length of the latch member 56 is longer than the longitudinal distance the latch member 56 covers along the nosepiece. As a result, the latch member 56 provides a mechanical advantage for tightening the interface between the latch mechanism 52 and the nose portion 30. In the latched position, the center portion of the latch member 56 presses firmly down upon and across the door 40. This arrangement ensures that, in the latched position, the door 40 is secured against the nose portion 30.

Also, in the latched position the latch cover 58 is separated from the housing 12 by a gap 82 (FIG. 2), which gives the latch cover space to pivot when the latch mechanism 52 is in the unlatched position.

To release the door 40, the latch cover 58 is urged away from the door 40, for example, by the user pulling up on the projecting member 76. Urging the latch cover 58 away from the door 40 disengages the latch member 56 from the hooks 36, thus allowing the door 40 to pivot about the projecting lip 49 of the door plate 48 and away from the nose portion 30. In the unlatched position, the user may then clear any jammed fastener from within the nosepiece assembly 24 by pulling the fastener along the longitudinal length of the nose portion 30 toward the nose tip.

Although a wire latch member, as illustrated, can be used to attach the cover to the nosepiece structure, any other element that can connect the latch cover to a nosepiece structure can be used. Lifting the rearward portion 72 of the latch cover releases the bias of the spring in the latched state. As a result, the latch cover can be raised off of the nose portion 30.

When lowered and/or closed, the latch cover 58 conceals the depth adjustment mechanism 100. The depth adjustment mechanism 100 includes the depth adjustment wheel 38, a shaft or adjustment screw 112, a stop member 114, and a ring member 116. The depth adjustment mechanism 100 is configured to change the total length of the nosepiece assembly 24 in order to vary the depth to which a fastener will be driven by the fastening tool 10. In an embodiment, when the depth adjustment wheel 38 is rotated in a first direction, the door 40 moves outwardly to reduce the depth to which a fastener will be driven by the fastening tool. Reducing the depth to which a fastener will be driven into a workpiece by the fastening tool is beneficial for soft woods and soft materials, such as, for example, pine. When the depth adjustment wheel 38 is rotated in a second direction, opposite to the first direction, the door 40 moves inwardly with the assistance of the resilient stop member 50 to increase the depth to which a fastener will be driven into a workpiece by the fastening tool. Increasing the depth to which a fastener will be driven into a workpiece is beneficial for harder woods and materials, such as, for example, oak.

Figure 11:
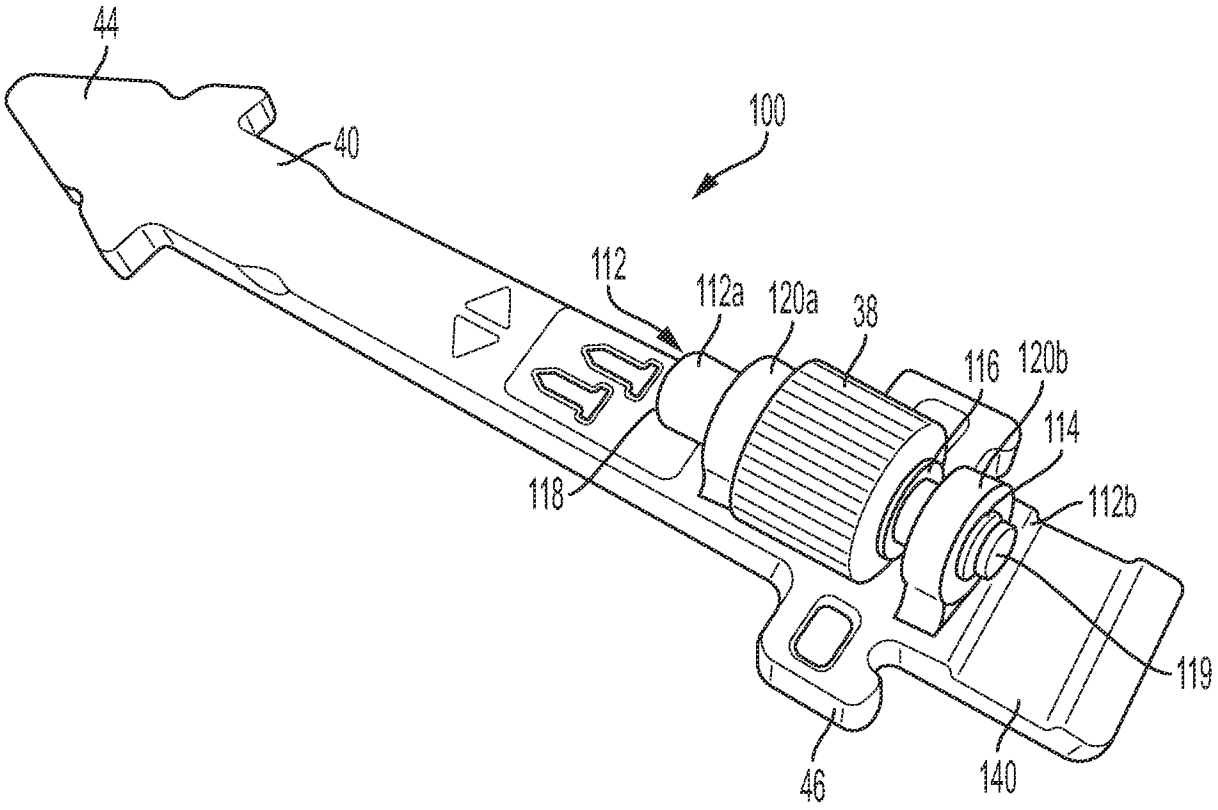
FIG. 11 is a rear perspective view of the depth adjustment mechanism.

As shown in FIG. 11, the depth adjustment wheel 38 can have a hollow cylindrical body with an inner surface defined by an aperture 138 centrally therethrough. The aperture 138 has a first diameter portion 138*a* and an adjacent second diameter portion 138*b*. In an embodiment, the first diameter portion 138*a* is larger than the second diameter portion 138*b*. The first diameter portion 138*a* can be an unthreaded section. The second diameter portion 138*b* can be a threaded section. The first diameter portion 138*b* can be positioned in the nosepiece to face the distal end 44 of the door 40, while the second diameter portion can be positioned to face the proximal end 42 of the door 40. A central or wheel axis 126 through the adjustment wheel 38 is parallel to the drive axis of the tool.

The adjustment screw 112 is disposed within the aperture 138 in the depth adjustment wheel 38 and is coaxial with the depth adjustment wheel.

The adjustment screw 112 has a substantially cylindrical body including a head portion 112*a* at a forward end 118 of the body and tail or shank portion 112*b* at the rearward end 119 of body. The head portion 112*a* is enlarged and has a greater diameter than the second diameter portion 138*b* of the depth adjustment wheel 38. The enlarged head portion 112*a* of the adjustment screw 112 can move within the first diameter portion of the depth adjustment wheel 38 and is prevented from entering the second diameter portion. As a result, the enlarged head portion limits the rearward axial position of the depth adjustment mechanism 100 when the depth adjustment wheel 38 is rotated in a direction to reduce the depth of the fastener fired.

Figure 13:
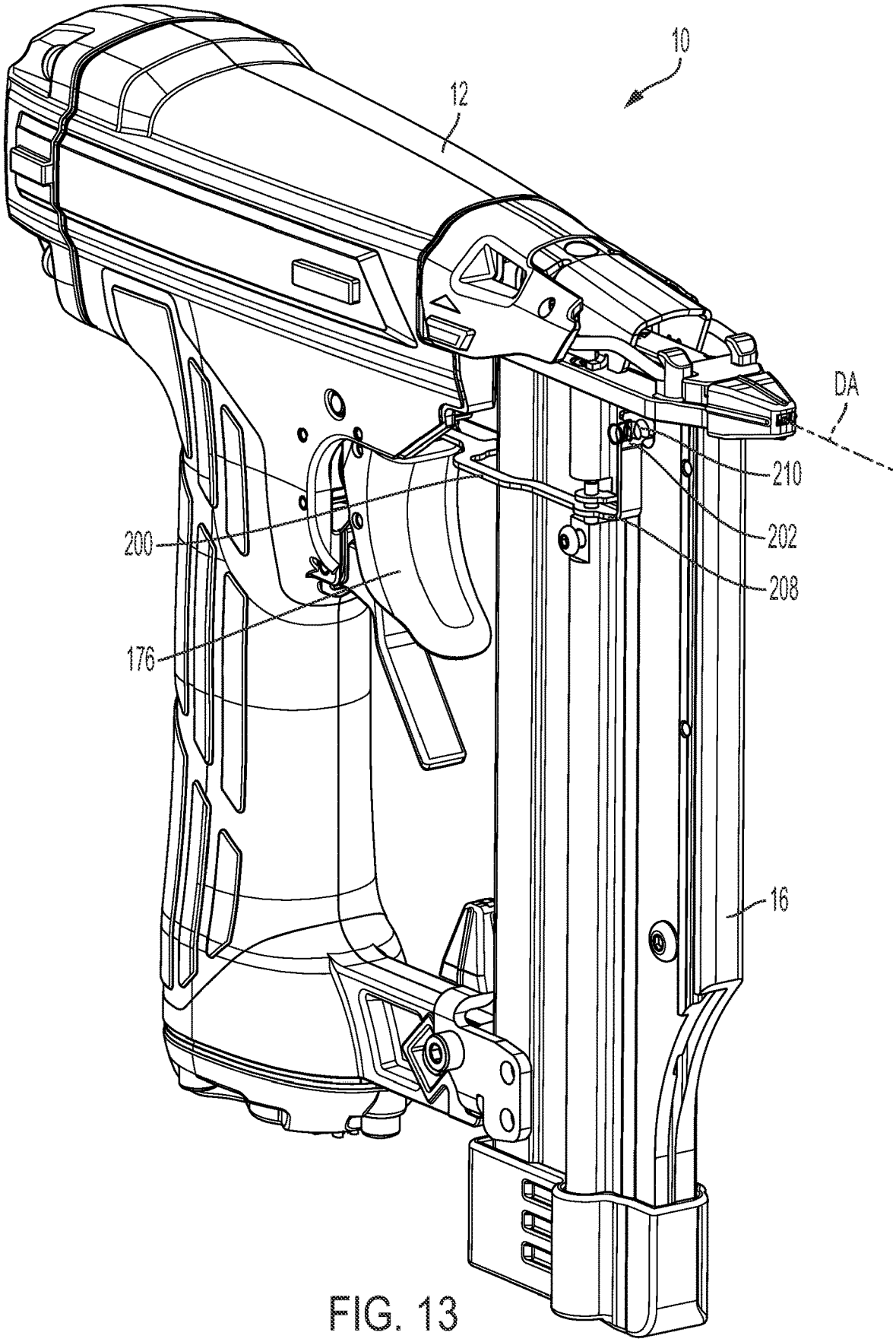
FIG. 13 illustrates the fastening tool having a low nail lockout mechanism.

The shank portion has a threaded section 124 on an outer surface thereof that engages the threaded section 138*b* of the depth adjustment wheel 38, so that a rotational movement of the depth adjustment wheel with respect to the adjustment screw effects a relative axial movement of the adjustment screw and longitudinal movement of the door 40 with respect to the nose to increase and decrease the depth that a fastener is driven into a workpiece. The smaller diameter shank portion 112*b* of the adjustment screw 112 can have a stop member 114 disposed thereon to limit the forward axial position of the depth adjustment mechanism when the depth adjustment wheel 38 is rotated in a direction to increase the depth that the fastener is fired. As such, the stop member 114 fixes the depth adjustment mechanism 100 in a position and prevents the adjustment screw 112 from rotating out of the depth adjustment wheel 38. In an embodiment, the stop member can be a rigid member, such as an E-ring, as illustrated in FIGS. 11 and 13. The adjustment screw can be disposed with a substantially circumferential notch in the shank portion for receiving the stop member 114.

Additionally, the ring member 116, prevents the depth adjustment wheel 38 from rotating when the tool is driving a fastener. In particular, the ring member 116 frictionally engages the depth adjustment wheel to retain the depth adjustment wheel in a desired rotational position with respect to the adjustment screw. In an embodiment, the ring member 116 can be an O-ring having elastomeric properties.

The depth adjustment mechanism 100 is mounted to the door 40 by forward and rearward mounting brackets 120*a*, 120*b* that are integrally formed on the planar surface of the door 40. The bracket supports the depth adjustment mechanism in a state of non-axial movement with respect to the door 40. The brackets project outwardly from a surface of the door 40 and support the adjustment screw 112. The brackets 120*a*, 120*b* each have an aperture therethough. The forward bracket 120*a* has a larger aperture than the rearward bracket 120*b*; however, the apertures are arranged such that the centers of the respective apertures are aligned. The forward bracket 120*a* is sized to support a clearance fit of the enlarged head portion 112*a* of the adjustment screw 112, while the rearward bracket 120*b* is sized to support a clearance fit of the smaller tail or shank portion 112*b*.

The apertures in the brackets are sized to the different diameters of the adjustment screw 112, to keep debris from entering the aperture 138 of the depth adjustment wheel 38, while still allowing linear movement of the adjustment screw.

Figure 12A:
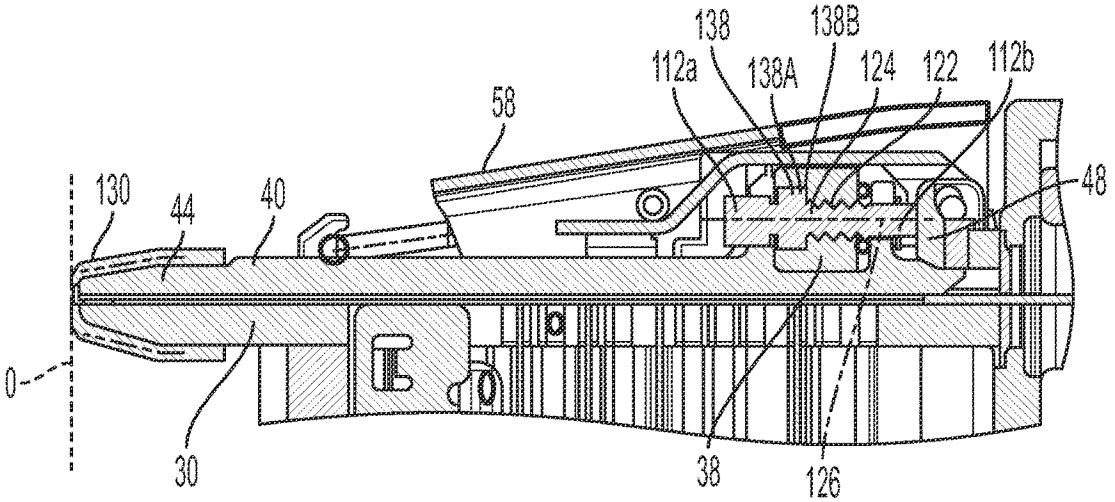
FIGS. 12A and 12B are cross-sectional views of the depth adjustment mechanism in the nosepiece assembly.
Figure 12B:
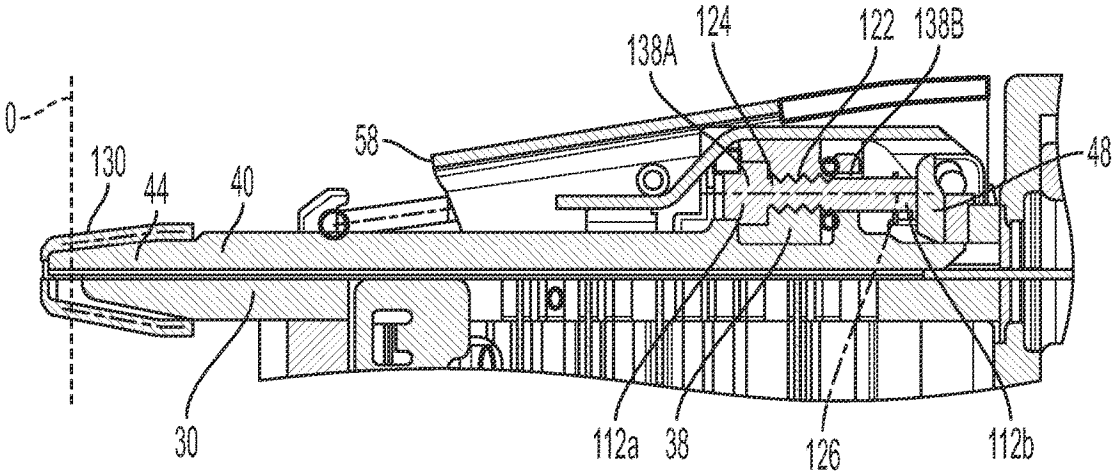

As shown in FIGS. 12A and 12B, the depth adjustment wheel 38 has inner threads 122 that engage outer threads 124 on the adjustment screw 112. The inner threads 122 of the adjustment wheel 38 are arranged to mesh with the outer threads 124 on the outer surface of the adjustment screw so that rotation of the depth adjustment wheel 38 moves the adjustment screw along the wheel axis 126 and effects linear or axial movement of the wheel.

The shank portion 112*b* of the adjustment screw 112 includes a threaded part 124 that engages the threaded section 122 of the depth adjustment wheel 38. In operation, rotation of the depth adjustment wheel 38 in a first direction moves the adjustment screw 112 toward the housing 12 to press against the door plate 48 to push the door 40 outwardly away from the housing to increase the length of the nosepiece assembly. The outward movement of the door is limited by resilient member 50, which biases the door 40 toward the housing 12. The shank portion 112*b* of the adjustment plate 112 moves linearly away from the depth adjustment wheel to push against the door plate 48. The shank portion 112*b* pushing against the door plate 48 causes an opposite movement of the pivoting door 40 outward toward the workpiece to reduce the depth of a driven fastener into the workpiece. As shown in FIG. 12B, the distal end 44 of the door extends beyond an original position indicated by the line O in FIG. 12A.

Further, when the wheel 38 is rotated in a second direction opposite to the first direction, the shank portion 112*b* of the adjustment screw 112 moves away from the door plate 48. As a result, the door 40 moves in a direction away from the workpiece, inwardly toward the housing to reduce the length of the nosepiece, and the depth of the driven fastener is increased.

As the depth adjustment mechanism is disposed on the moving door 40, the mechanism is axially moved relative to the nose portion during the depth adjusting movement of the adjustment screw.

In an embodiment, the shank portion can additionally have an unthreaded part and the threaded part can be disposed between the unthreaded part and the head portion.

The depth adjustment wheel 38 and adjustment screw 112 can be formed from any material, including, but not limited to a metal, such as steel. Additionally, the adjustment screw can have an alternative geometry.

In an embodiment of the present invention, the fastening tool also includes a low nail lockout mechanism 190 that prevents the tool from driving a fastener with there are less than a predetermined number of fasteners in the magazine 16. In particular, the low nail lockout mechanism prevents the trigger arm 178 from contacting the trigger valve 172 and trigger valve stem 174 to activate the tool.

Figure 14:
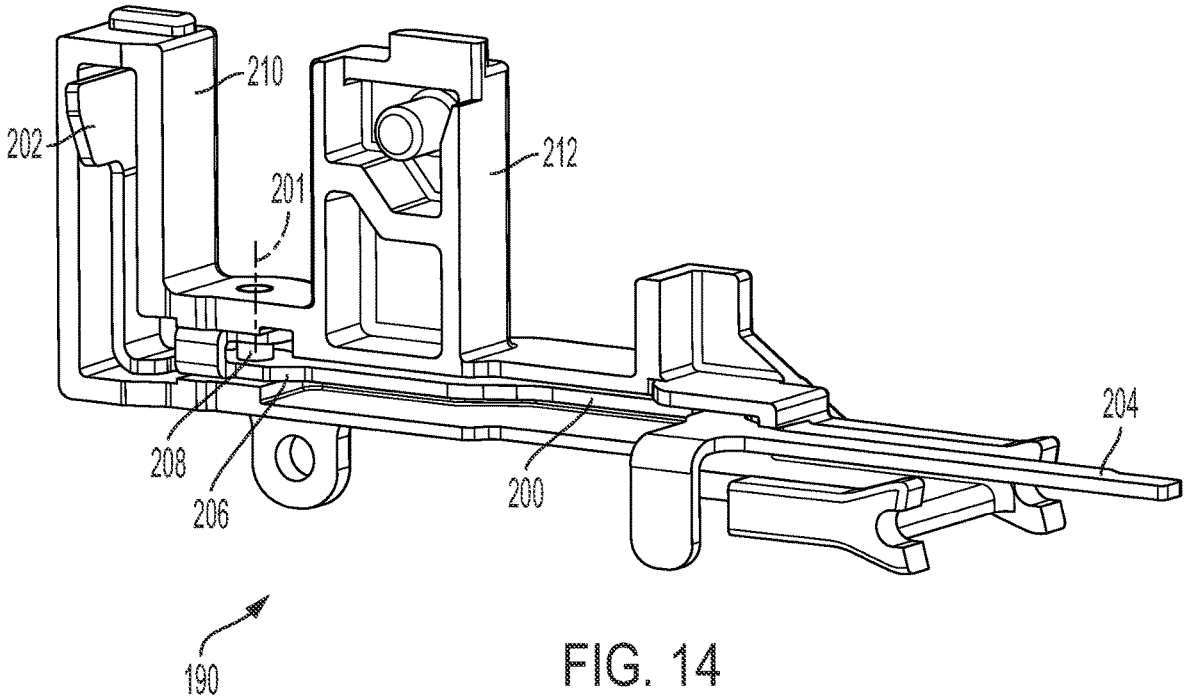
FIG. 14 illustrates an enlarged view of the low nail lockout mechanism within a lockout lever housing.

As shown in FIG. 13, the low nail lockout mechanism 190 includes a contact or lockout lever 200 that is pivotably mounted to the housing 12. The contact or lockout lever 200 can be disposed on a side of the magazine assembly so as to engage with the magazine assembly when there are less than a predetermined number of fasteners therein. As shown in FIG. 13 and in more detail in FIG. 14, the lockout lever 200 has an elongated body. The body can be arranged in parallel to the fastener drive track 26. The lockout lever 200 can be defined by a head portion 202 extending perpendicularly from one end of the elongated body, a tail portion 204 at an opposite longitudinal end of the elongated body, and an intermediate portion 206 located between the head portion and the tail portion. The intermediate portion 206 includes an aperture 207 in which a pivot member 208 is disposed and defines a pivot axis 201 about which the lockout lever 200 pivots on at least one of the housing 12 and magazine assembly and with respect to the magazine assembly 16.

A biasing member 210 such as a spring, biases the head portion 202 in a first direction and the tail portion 204 in a second direction opposite to the first direction. In an embodiment, the first direction is a direction toward the magazine assembly 16.

The biasing member 210 is arranged about the head portion 202 of the lockout lever 200. In an embodiment, the biasing member can be in the form of a compression spring or a coil spring.

The lockout lever 200 can be disposed within a lockout lever housing 212. The lockout lever housing 212 can be formed from a material including, but not limited to plastic.

FIGS. 15, 16A, 16B, 17A and 17B illustrate the state of the lockout lever 200 and operation of the low nail lockout mechanism when there are fasteners in the magazine assembly 16.

Figure 15:
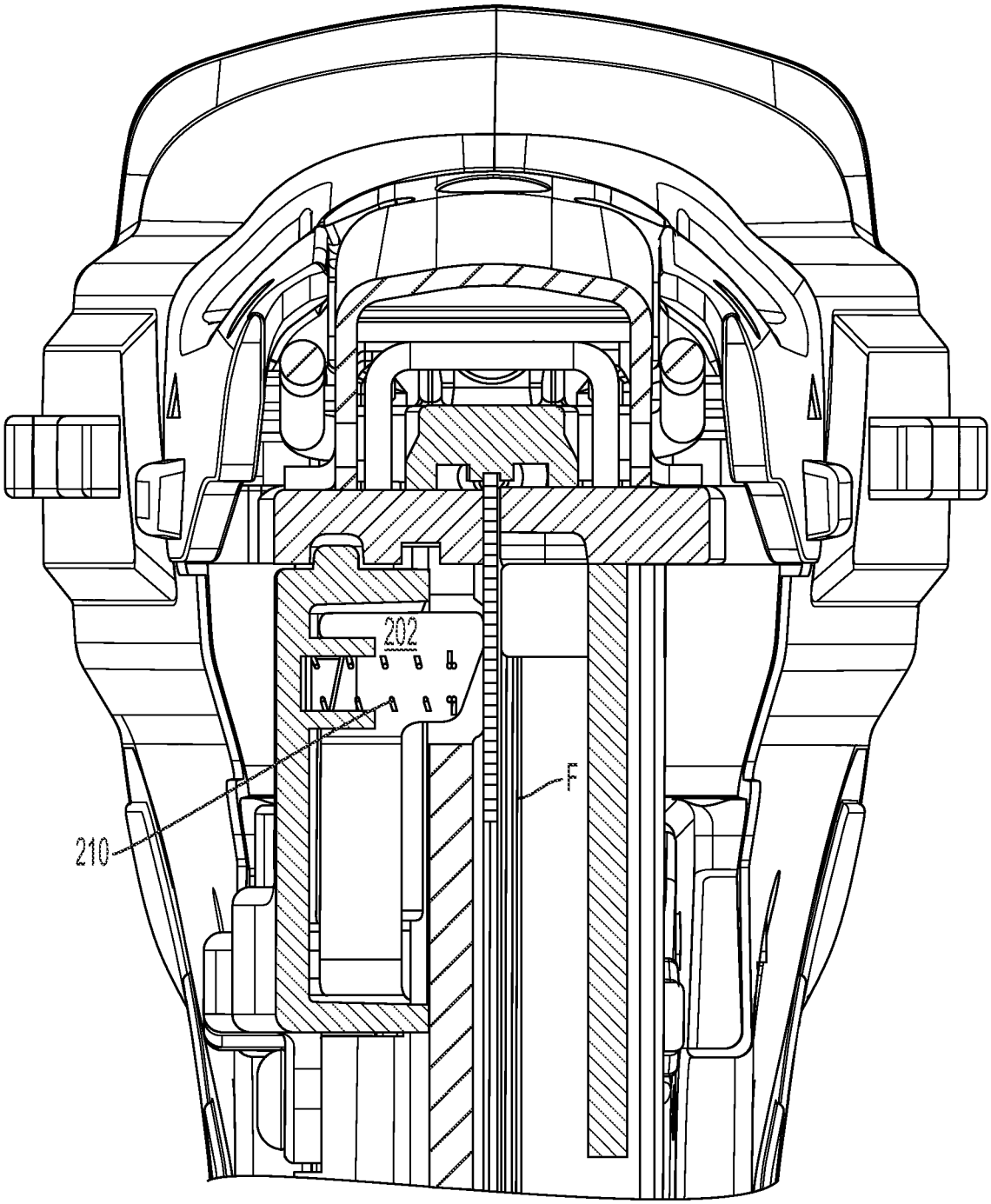
FIG. 15 illustrates a front view of the fastening tool and the low nail lockout mechanism when there are fasteners in the magazine.
Figure 16A:
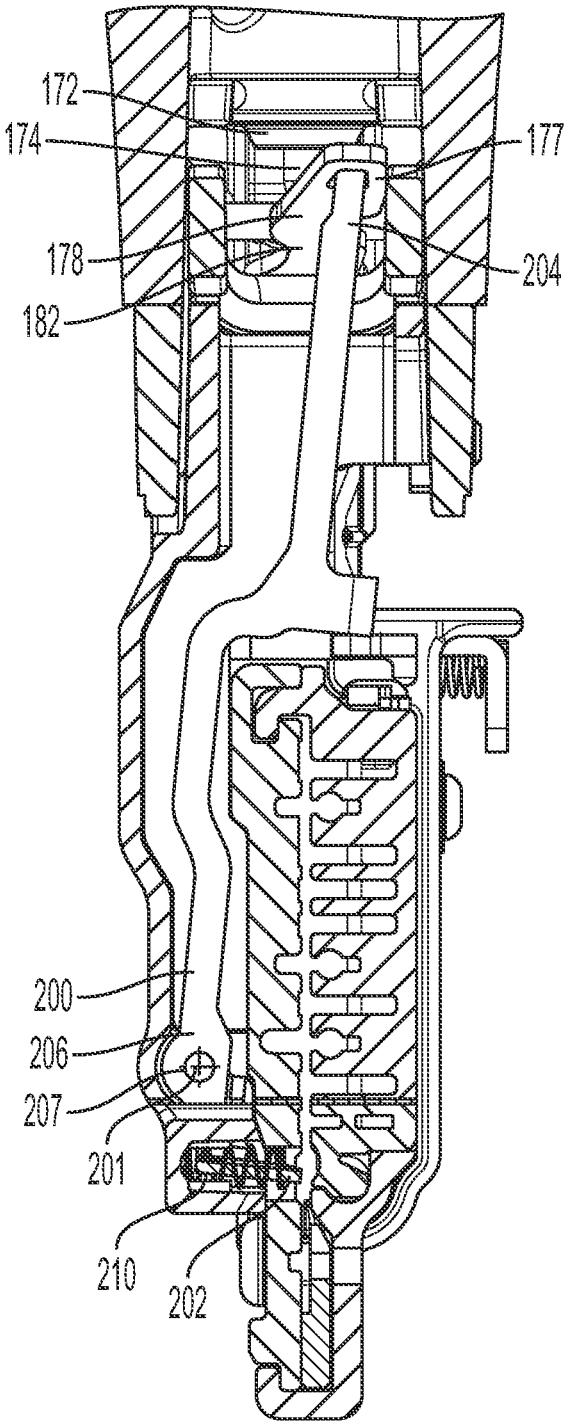
FIGS. 16A and 16B illustrate the relationship between the low nail lockout mechanism and the trigger assembly when there are fasteners in the magazine when the trigger is at rest.
Figure 16B:
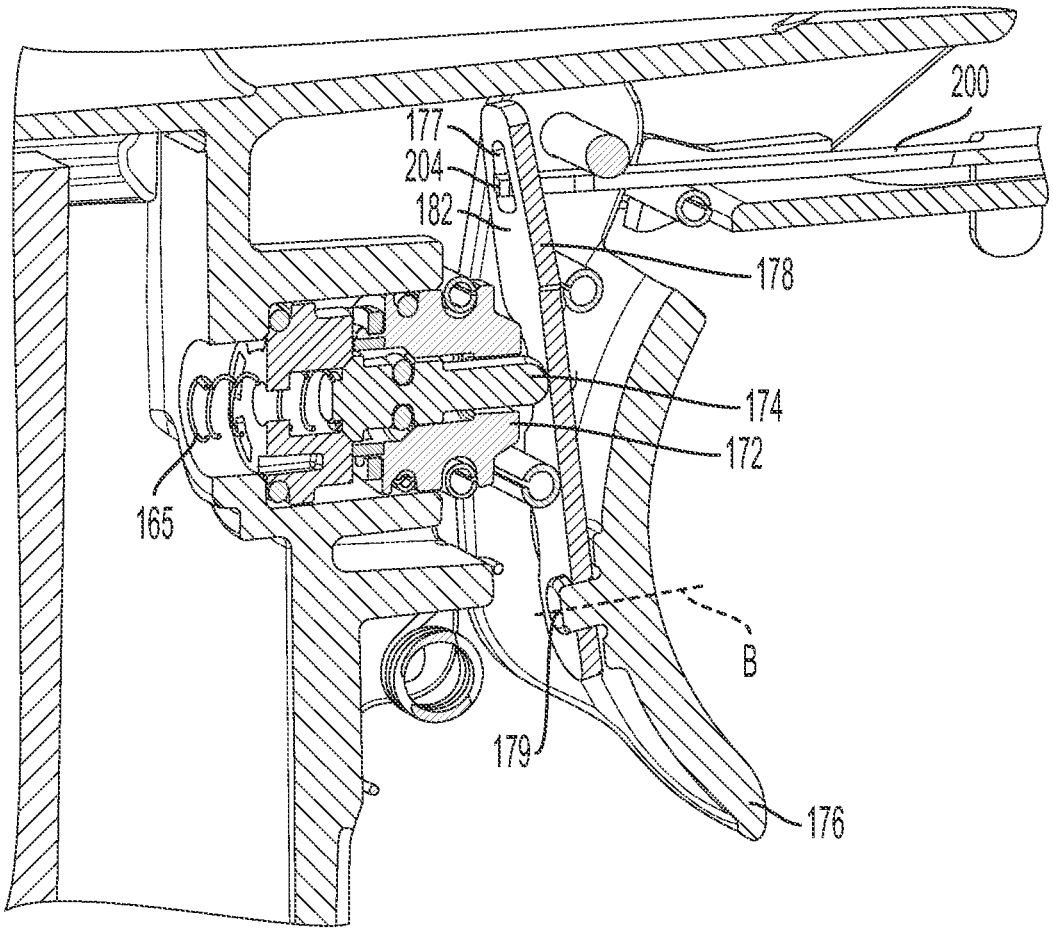

FIGS. 15, 16A, 16B illustrate a state in which there are fasteners in the magazine assembly 16 and the trigger 176 is at rest. The valve stem 174 is also at rest and is not in contact with the trigger arm 178. When there are fasteners in the magazine assembly 16, the lockout lever 200 is rotated to the first position in which the head 202 of the lockout lever is outside of the path 29 of the magazine pusher 27. Also, the tail 204 of the lockout lever 200 is pivoted toward the magazine assembly 16.

As shown in FIGS. 15, 16A and 16, the biasing member 210 biases the head portion 202 of the lockout lever 200 in the first direction toward the magazine assembly. However, due to the presence of fasteners in the magazine assembly 16, the head portion 202 of the lockout lever remains outside of a path 29 of the magazine pusher 27. The tail end 204 of the lockout lever 200 is disposed within an aperture 177 in the trigger arm 178 and biased in a second direction opposite to the first direction. With the tail portion 204 of the lockout lever 200 within the aperture 177 of the trigger arm 178, the tail portion 204 is able to control the lateral position of the trigger arm 178 between a first or engaged position where the trigger arm 178 contacts the valve stem 174 and a second or disengaged position where the trigger arm is not in contact with the valve stem 174. As shown in the Figures, the surface of the trigger arm 178 is in a position to contact the trigger valve stem 174.

Figure 17A:
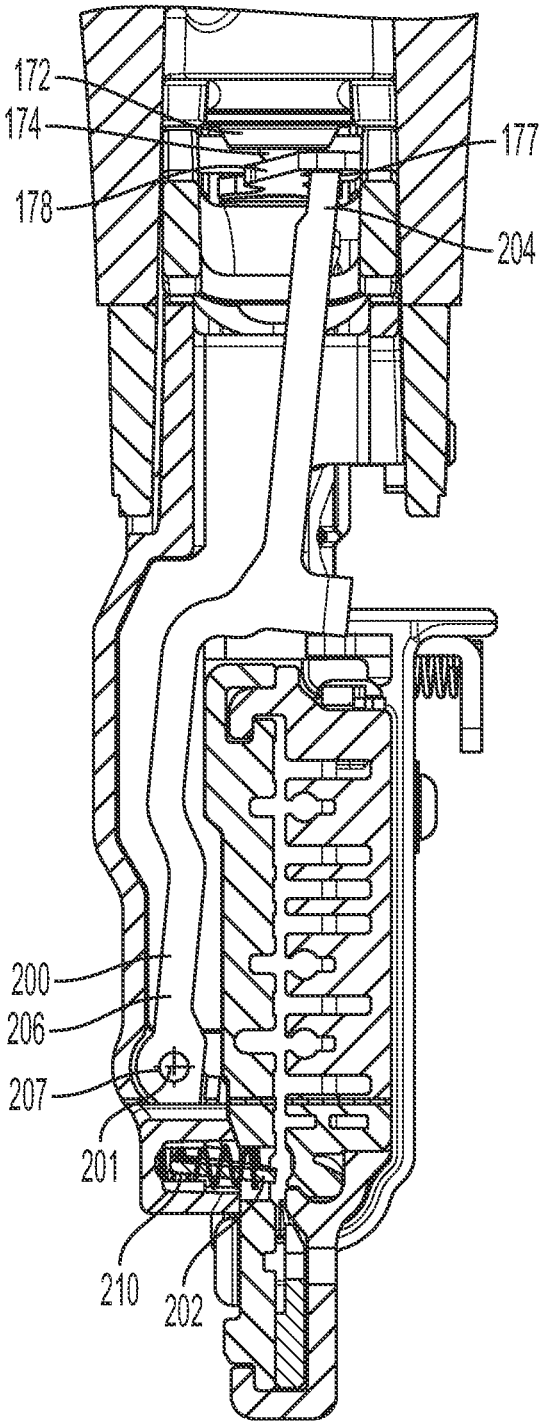
FIGS. 17A and 17B illustrate the relationship between the low nail lockout mechanism and the trigger assembly when there are fasteners in the magazine when the trigger has been pulled.
Figure 17B:
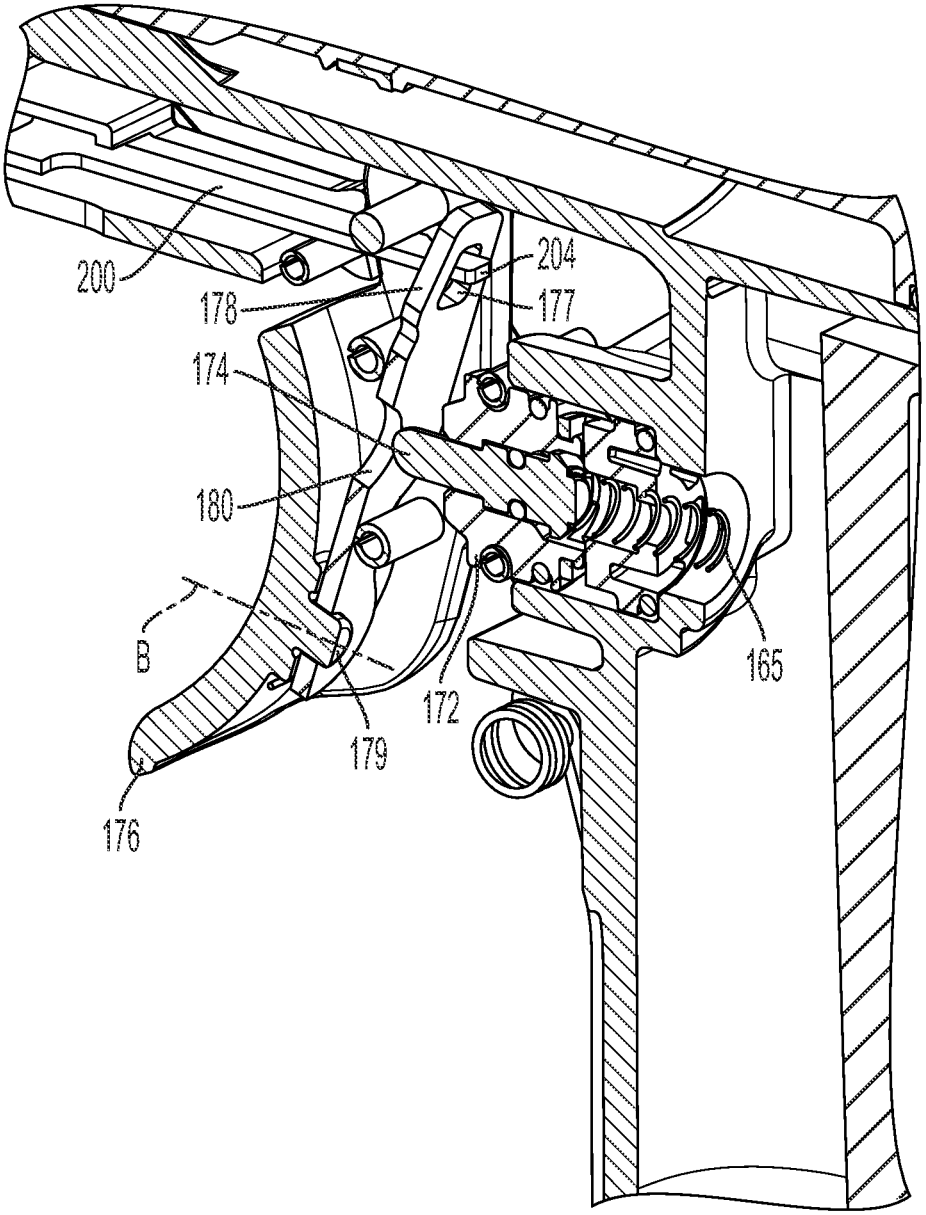

FIGS. 17A and 17B, illustrate a state in which there are fasteners in the magazine assembly 16 and the trigger 176 is pulled. With the trigger arm 178 in the first position, a solid portion or surface 182 of the trigger arm 178 is in a position to engage the valve stem 174. When the trigger 176 is pulled, the end of the trigger arm 178 connected through the aperture 177 to the tail portion 204 of the lockout lever 200 pivots downward or toward the tip of the nosepiece portion 30. The body of the trigger arm 178 is pivoted in a direction upward or toward the trigger valve 172 to engage and push the trigger valve stem 174 and thereby open the trigger valve 172. Accordingly, when the trigger 176 is pulled, the valve stem 174 can contact the trigger arm 178. FIG. 17B is an enlarged view of the actuation of the tool 10 by the valve stem 174 being pressed by the trigger arm 178.

FIGS. 18, 19A, 19B, 20A and 20B illustrate the state of the lockout lever 200 and operation of the low nail lockout mechanism when there are less than a predetermined number of fasteners in the magazine assembly 16.

Figure 18:
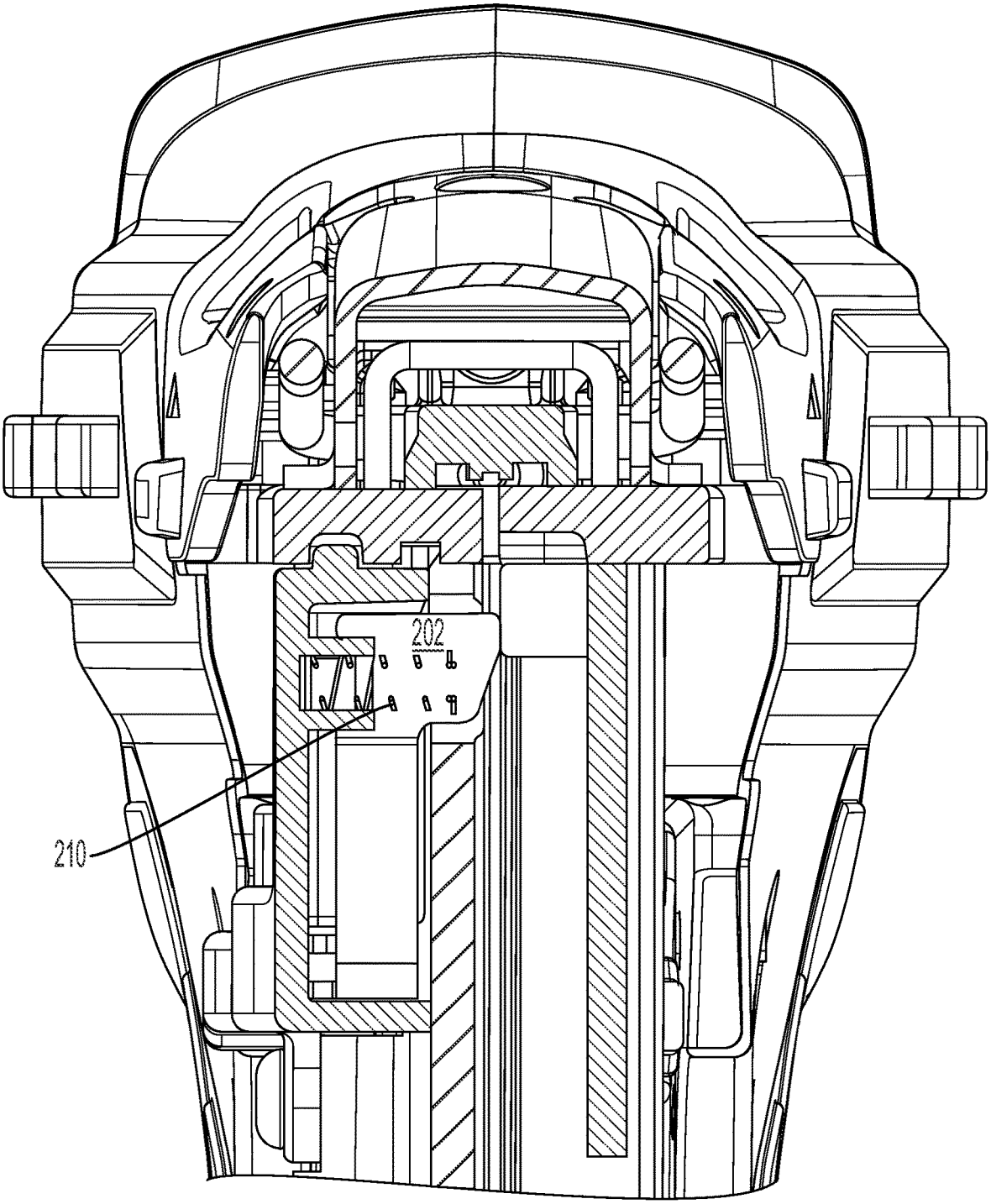
FIG. 18 illustrates a front view of the fastening tool and the low nail lockout mechanism when there are no fasteners in the magazine.

As shown in FIG. 18, when there are less than a predetermined number of fasteners in the magazine assembly 16, such as six fasteners or less, or for example, zero fasteners, the biasing member 210 biases the lockout lever 200 to a second position in which the head portion 202 of the lockout lever is in the path 29 of the magazine pusher 27.

Figure 19A:
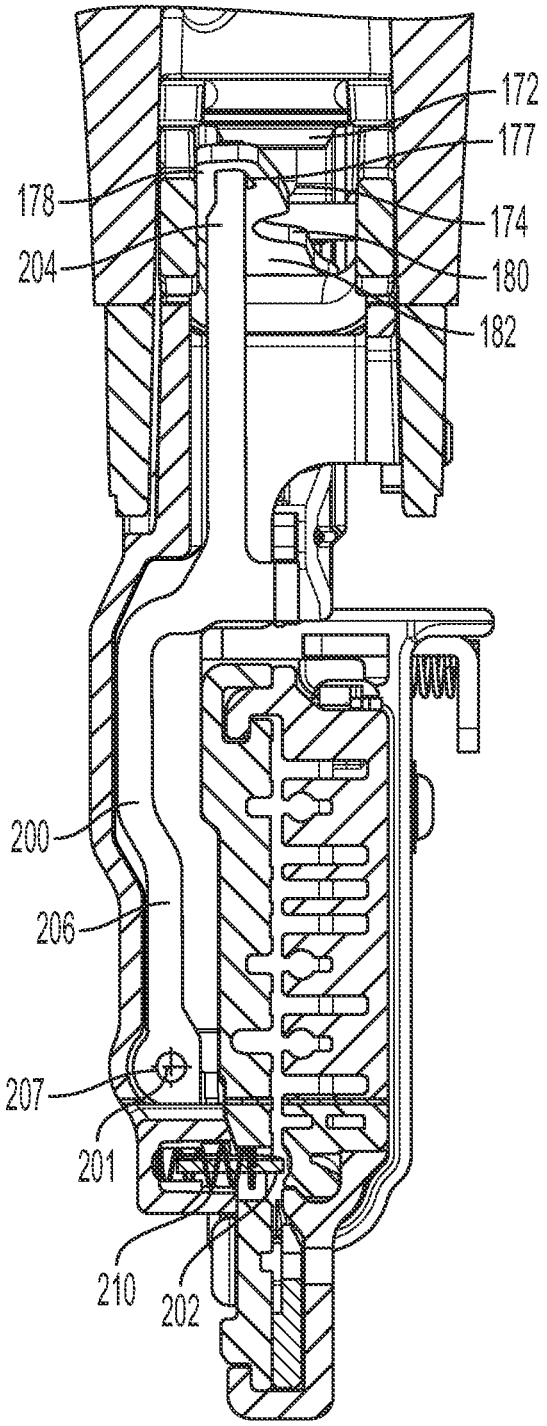
FIGS. 19A and 19B illustrate the relationship between the low nail lockout mechanism and the trigger assembly when there are no fasteners in the magazine when the trigger is at rest.
Figure 19B:
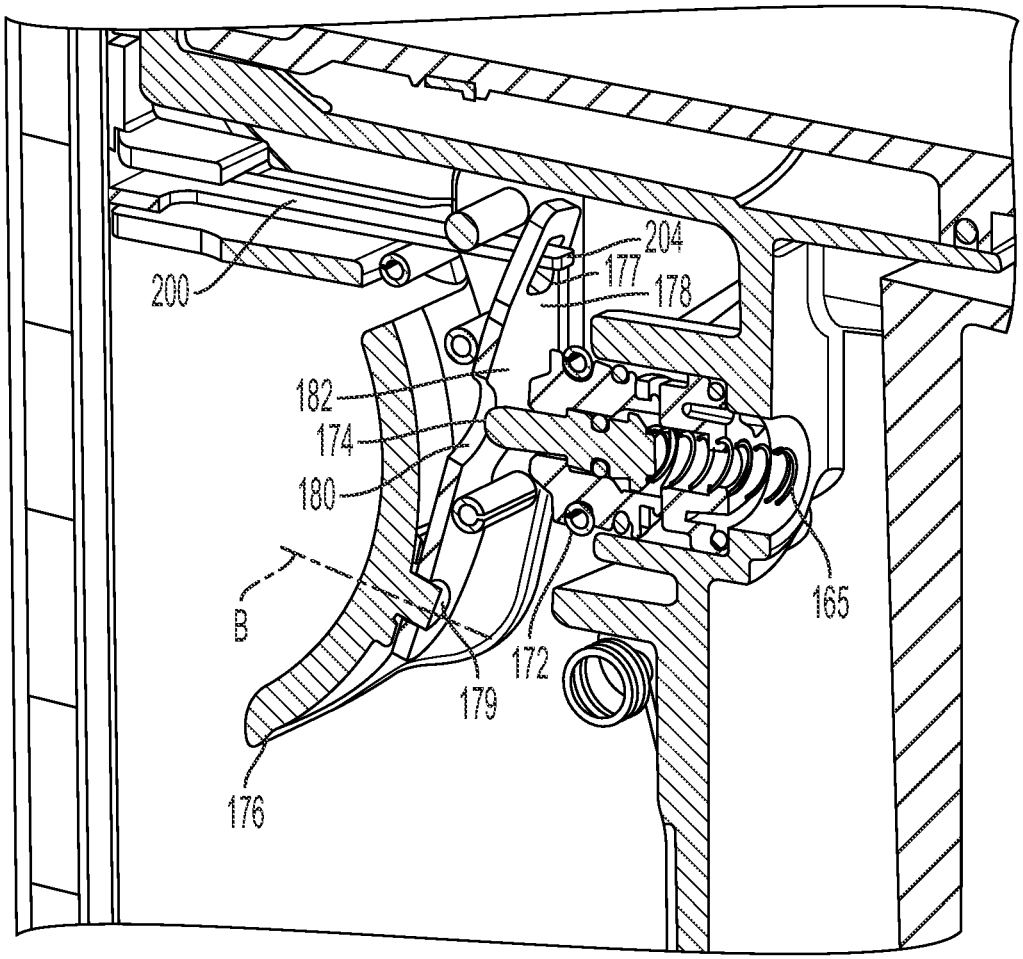

In FIGS. 19A and 19B, the trigger 176 and valve stem 174 are at rest and not in contact with each other. When there are less than a predetermined number of fasteners in the magazine assembly 16, the lockout lever 200 is rotated to the second position in which the head 202 of the lockout lever is biased into the path 29 of the magazine pusher 27. Also, as shown in FIG. 19A, the tail 204 of the lockout lever 200 is in the second position is biased away from the magazine assembly 16.

FIG. 19A illustrates the arrangement of the trigger arm 178 and the valve stem 174 when the tail portion 204 of the lockout lever 200 has shifted the trigger arm 178 to the second position, such as to the left in the figure. The trigger arm 178 can have a cutout portion or recess 180, such as for example, a half-moon cutout or recess, cut from the solid portion 182. With the trigger arm 178 in the second position, the solid portion 182 of the trigger arm 178 is not in a position to engage the valve stem 174. Rather, the recess 180 of the trigger arm opposes the valve stem 174. Thus, when there are no fasteners and the trigger 176 is pulled, the trigger arm 178 bypasses the valve stem 174 through the recess 180 and does not engage the trigger valve. As such, the trigger valve 172 does not open.

Figure 20A:
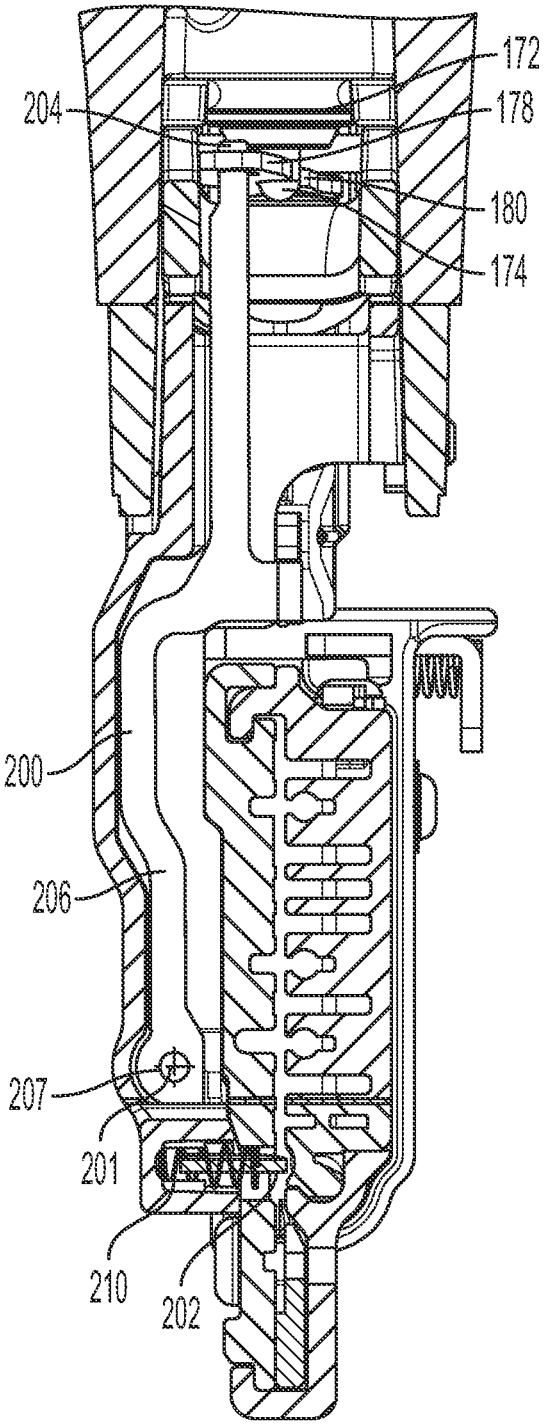
FIGS. 20A and 20B illustrate the relationship between the low nail lockout mechanism and the trigger assembly when there are no fasteners in the magazine when the trigger has been pulled.
Figure 20B:
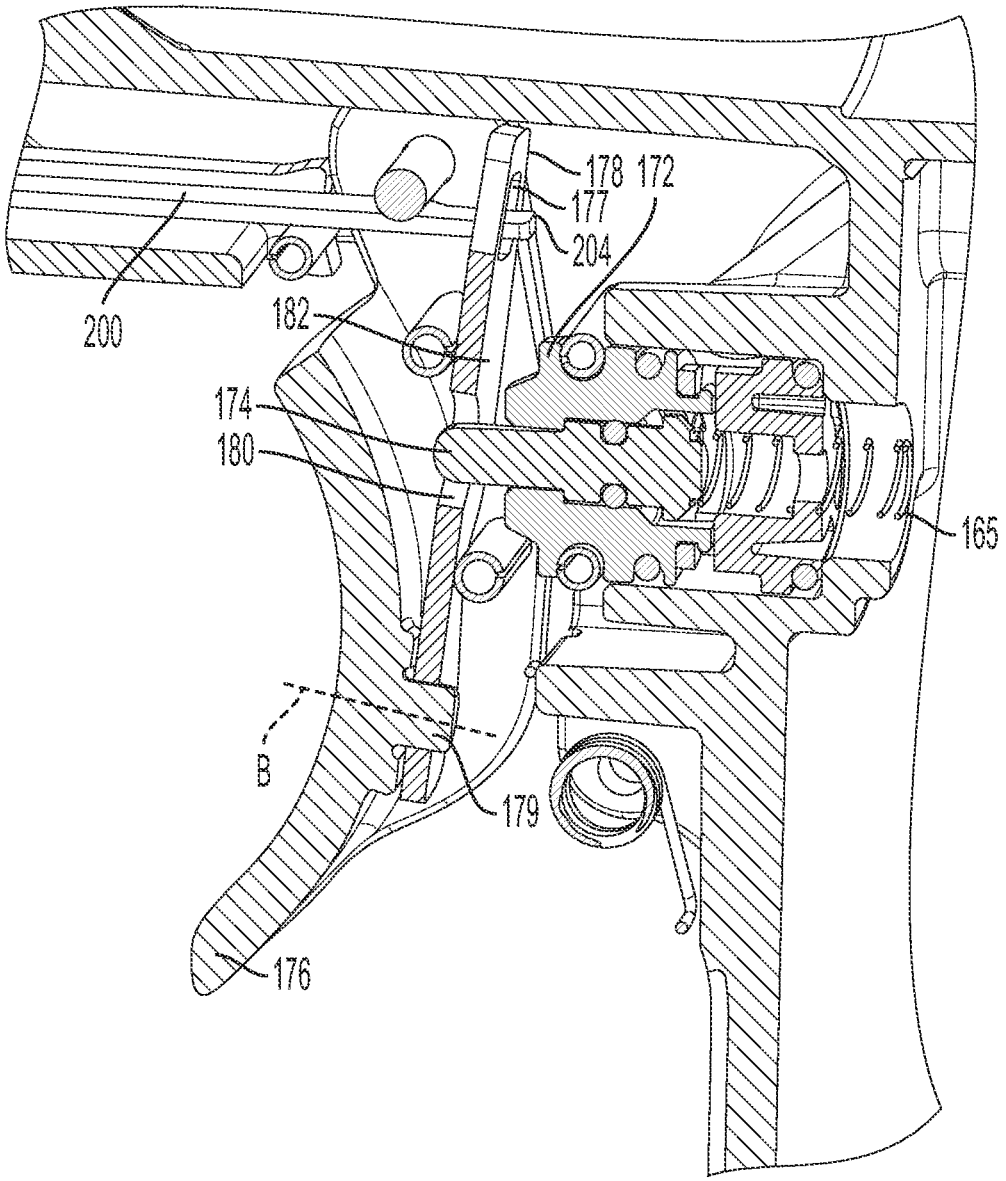

Accordingly, when the trigger 172 is pulled or moved to the actuated position as shown in FIGS. 20A and 20B, the valve stem 174 passes through the recess 180 in the trigger arm 178. When the valve stem passes through the recess 180 of the tool, the valve stem is not pressed. In particular, the trigger 176 through the trigger arm 178 is not able to engage the valve stem 174 and cannot press the valve stem 174 against the bias of the valve spring 165 in the trigger valve 172. Therefore, the trigger valve 172 cannot be actuated, i.e. because the valve stem 174 is not moved against the bias of the valve spring 165 in the trigger valve 172. Accordingly, the passageway within the trigger valve 172 between the chamber above the head valve 168 and the exhaust opening remains closed, and the pressurized gas in the chamber is not able to flow through the trigger valve 172 and out the exhaust opening.

FIG. 20B is an enlarged view of the gap through which the valve stem 174 passes, preventing the valve stem 174 from being pressed against the trigger arm 178 and preventing actuation of the tool 10.

Figure 21:
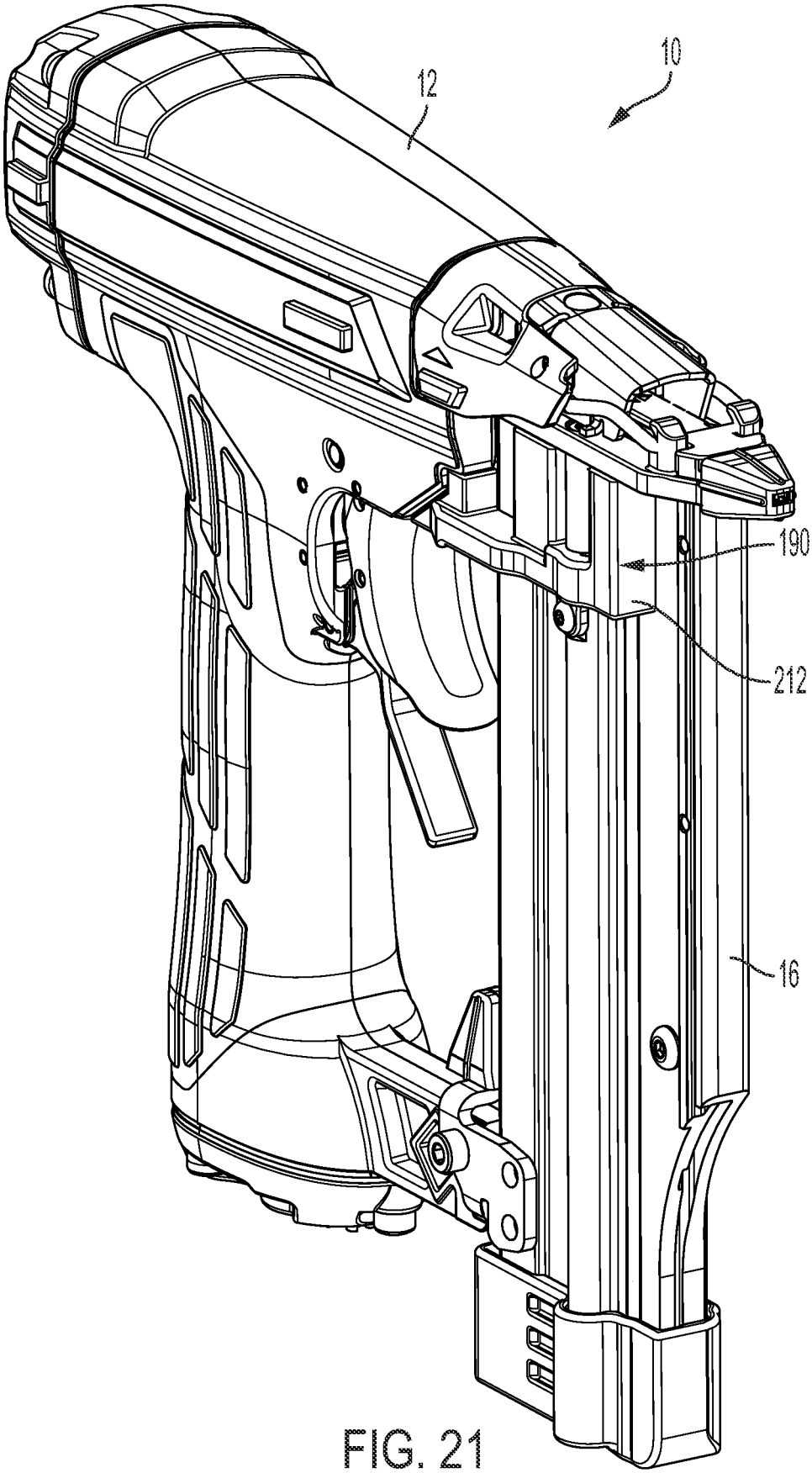
FIG. 21 illustrates the lockout lever housing.
Figure 22:
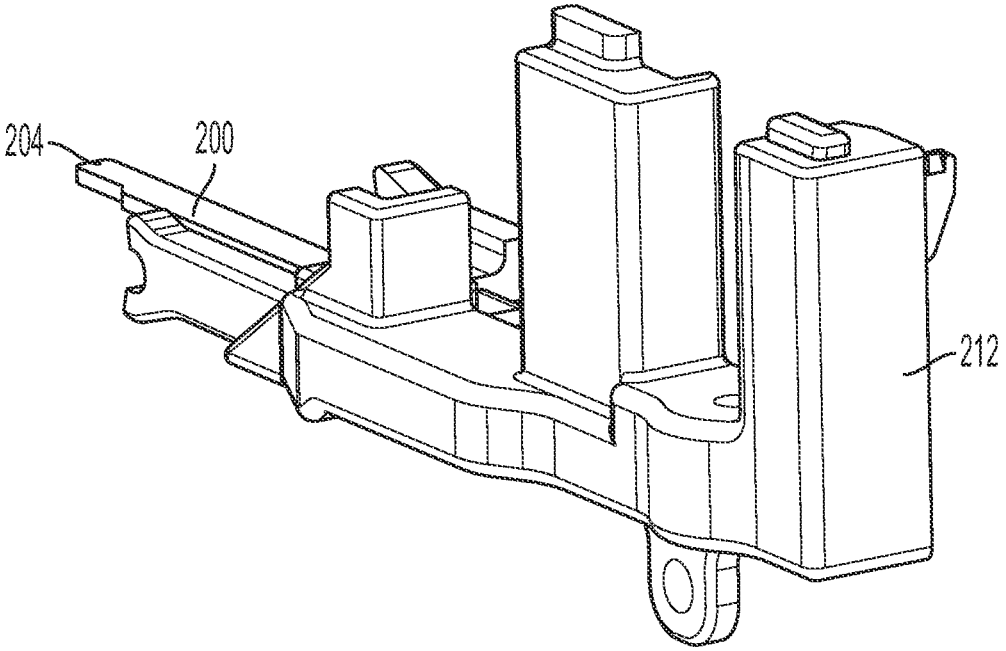
FIG. 22 illustrates an enlarged view of the lockout lever housing.

FIG. 21 illustrates the lockout lever housing 212 as mounted onto at least one of the magazine assembly 16 and the housing 12. FIG. 22 illustrates an enlarged view of the lockout lever housing 212.

While aspects of the present invention are described herein and illustrated in the accompanying drawings in the context of a fastening tool, those of ordinary skill in the art will appreciate that the invention, in its broadest aspects, has further applicability.

It will be appreciated that the above description is merely exemplary in nature and is not intended to limit the present disclosure, its application or uses. While specific examples have been described in the specification and illustrated in the drawings, it will be understood by those of ordinary skill in the art that various changes may be made and equivalents may be substituted for elements thereof without departing from the scope of the present disclosure. Furthermore, the mixing and matching of features, elements and/or functions between various examples is expressly contemplated herein, even if not specifically shown or described, so that one of ordinary skill in the art would appreciate from this disclosure that features, elements and/or functions of one example may be incorporated into another example as appropriate, unless described otherwise, above. Moreover, many modifications may be made to adapt a particular situation or material to the teachings of the present disclosure without departing from the essential scope thereof. Therefore, it is intended that the present disclosure not be limited to the particular examples illustrated by the drawings and described in the specification as the best mode presently contemplated for carrying out the teachings of the present disclosure, but that the scope of the present disclosure will include any embodiments falling within the foregoing description and the following claims.

We claim:

1. A fastening tool comprising:

a housing;

a nosepiece assembly connected to the housing and including a fastener drive track;

a magazine assembly including a magazine pusher slidably disposed in the magazine assembly for feeding fasteners successively along a pusher path to the fastener drive track of the nosepiece assembly;

an engine carried by the housing and configured to drive the fastener along a drive axis out of the fastener drive track and into a workpiece;

a trigger pivotably connected to the housing;

a trigger valve that selectively controls the flow of pressurized gas to the engine when the trigger is pulled;

a trigger arm pivotably mounted on the trigger and having an engaged position and a disengaged position, the trigger arm operable to actuate the trigger valve when the trigger arm is in the engaged position and to bypass the trigger valve when the trigger arm is in the disengaged position; and a lockout lever pivotally mounted to the housing and configured to move the trigger arm from the engaged position to the disengaged position when there are less than a predetermined number of fasteners in the magazine assembly.

2. The fastening tool according to claim 1, wherein in the engaged position, a surface of the trigger arm presses against the trigger valve allowing the flow of pressurized gas to enter the engine and activate the tool.

3. The fastening tool according to claim 1, wherein the trigger arm defines a recess in a surface thereof and wherein in the disengaged position, the trigger arm bypasses the trigger valve at the recess, preventing pressurized gas from entering the engine, thereby preventing activation of the tool.

4. The fastening tool according to claim 1, wherein the lockout lever defines a head portion at one end that is biased toward the pusher path, the head portion protruding into the pusher path when there are less than a predetermined number of fasteners in the magazine assembly.

5. The fastening tool according to claim 4, wherein the head portion of the lockout lever is biased by a compression spring.

6. The fastening tool according to claim 4, wherein the lockout lever defines a tail portion at an opposite second end to the head portion, the tail portion operatively connected to and controlling movement of the trigger arm.

7. The fastening tool according to claim 6, wherein the tail portion of the lockout lever is operatively connected to the trigger arm through an aperture at one end of the trigger arm.

8. The fastening tool according to claim 6, wherein when the head portion of the lockout lever moves to protrude into the pusher path, the tail portion of the lockout lever moves the trigger arm to the disengaged position.

9. The fastening tool according to claim 6, wherein the lockout lever defines an intermediate portion between the head portion and the tail portion, the intermediate portion defining a pivot point about which the lockout lever is pivotally mounted to the housing.

10. The fastening tool according to claim 6, wherein when the head portion of the lockout lever is biased to protrude into the pusher path, the tail portion of the lockout lever moves away from the magazine assembly.

11. The fastening tool according to claim 4, wherein the lockout lever has an elongated lockout lever body arranged parallel to the drive axis and the head portion extends perpendicularly from the lockout lever body.

12. The fastening tool according to claim 1, wherein the lockout lever is formed from a metal.

13. The fastening tool according to claim 1, further comprising a lockout lever housing encasing the lockout lever.

14. The fastening tool according to claim 13, wherein the lockout lever housing is arranged on a laterally opposite side of the magazine to the magazine pusher.

15. The fastening tool according to claim 14, wherein the head portion of the lockout lever protrudes into the pusher path through a slot in the magazine assembly.

16. A low nail lockout mechanism for a fastening tool comprising:

a lockout lever having an elongated body and being defined by:

a head portion extending perpendicularly from one end of the elongated body, the head portion being planar, a tail portion at an opposite longitudinal end of the elongated body, and an intermediate portion between the head portion and the tail portion and defining a pivot axis about which the lockout lever pivots, the pivot axis being orthogonal to a plane of the head portion; and a biasing member that biases the head portion in a first direction and the tail portion in a second direction opposite to the first direction.

17. The low nail lockout mechanism according to claim 16, wherein the biasing member engages the lockout lever at the head portion.

18. The low nail lockout mechanism according to claim 16, wherein the biasing member comprises a compression spring.

19. The low nail lockout mechanism according to claim 16, further comprising a lockout lever housing that encases the lockout lever.

20. The low nail lockout mechanism according to claim 19, wherein the lockout lever is moveable relative to the lockout lever housing.

* * * * *